US008231242B2

(12) United States Patent
Kotovsky et al.

(10) Patent No.: US 8,231,242 B2
(45) Date of Patent: Jul. 31, 2012

(54) METHOD AND APPARATUS FOR LIGHTING INVOLVING REFLECTORS

(76) Inventors: Irwin Kotovsky, Pittsburgh, PA (US); Serge Cornelissen, Roeselare (BE); Robert Cornelissen, Roeselare (BE)

( * ) Notice: Subject to any disclaimer, the term of this patent is extended or adjusted under 35 U.S.C. 154(b) by 0 days.

(21) Appl. No.: 12/927,272

(22) Filed: Nov. 11, 2010

(65) Prior Publication Data

US 2011/0085331 A1 Apr. 14, 2011

Related U.S. Application Data

(63) Continuation of application No. 11/717,253, filed on Mar. 12, 2007, now Pat. No. 7,832,907, which is a continuation of application No. 10/813,319, filed on Mar. 30, 2004, now Pat. No. 7,207,698.

(51) Int. Cl.
*F21V 1/00* (2006.01)

(52) U.S. Cl. ..... 362/235; 362/275; 362/269; 362/271

(58) Field of Classification Search ..... 362/235, 362/71, 275, 269–272
See application file for complete search history.

(56) References Cited

U.S. PATENT DOCUMENTS 5,690,420 A * 11/1997 Saldana, Sr. ..... 362/540
6,416,195 B1 * 7/2002 Lin ..... 362/35
6,511,208 B1 * 1/2003 Kotovsky ..... 362/285

* cited by examiner

*Primary Examiner* — Evan Dzierzynski
(74) *Attorney, Agent, or Firm* — Ansel M. Schwartz

(57) ABSTRACT

A variety of lighting apparatuses are described that utilize reflection as a basis for lighting a desired area.

5 Claims, 45 Drawing Sheets

METHOD AND APPARATUS FOR LIGHTING INVOLVING REFLECTORS

RELATED APPLICATIONS

This is a continuation of U.S. patent application Ser. No. 11/717,253 filed Mar. 12, 2007 now U.S. Pat. No. 7,832,907, which is a continuation of U.S. patent application Ser. No. 10/813,319 filed on Mar. 30, 2004, now U.S. Pat. No. 7,207,698 issued Apr. 24, 2007.

FIELD OF THE INVENTION

The present invention is related to lighting apparatuses. More specifically, the present invention is related to lighting apparatuses that utilize reflectors in some form or fashion.

BACKGROUND OF THE INVENTION

Indirect light is a pleasing manner of providing the light required for various tasks. With indirect light, less foot-candles (quantity of light) is required to provide the same illumination levels as with direct light. The infinite reflector series allows you the possibility of indirect illumination in the most unique and innovative way. Reflectors permit you to redirect light.

The IRS (Infinite Reflector Series) offers the opportunity of infinite lighting design. You have a choice of reflective surfaces and shapes of reflectors to provide you infinite bouncing beams of light to illuminate various objects. You can with one source illuminate infinite objects or you can with infinite sources illuminate one object. You can redefine existing spaces with interceptors (reflectors) portable or fixed. The method of fixing to floors, walls or ceilings can be accomplished with clamps, suction cups, mounting plates, cables (stainless steel, nylon, rubber, rope, etc.), or tubes, as well as other means.

Interceptors (reflectors) can be placed in inaccessible places while the lamp source is placed in an accessible location and obtain the same results as if the source were in an inaccessible location. As an example, in a ceiling of 30 feet or more, which might normally have recessed fixtures, you can place reflectors. The light source could be mounted on walls at 6 or 8 feet in height (easily accessible). The light would be directed towards the reflectors, which would in turn redirect the light in a similar manner of a downlight. The reflector, therefore, replaces the source of illumination. As a result, high ceilings no longer present a relamping problem. In addition, wiring cost savings can be achieved, as it may no longer be necessary to run wiring in the ceiling.

SUMMARY OF THE INVENTION

The present invention pertains to a lighting apparatus. The apparatus comprises a light source which produces a light. The apparatus comprises a housing in which the light source is disposed. The housing having a front face through which the light emanates from the housing. The housing having a first side and an interior. The apparatus comprises a first shutter rotatably connected to the housing which can be set at a closed position that prevents light from emanating from the front face, and an open position that does not block any light from emanating from the front face, or any angle between the open position and the closed position. The first shutter having an inside face facing toward the interior and an outside face facing away from the interior. The outside face having a reflector material which reflects the light which strikes it.

The present invention pertains to a lighting apparatus for a building structure. The apparatus comprises a light source. The apparatus comprises a holder for the light source. The apparatus comprises an attachment connected to the holder to hold the holder to the building structure. The apparatus comprises a motor means. The apparatus comprises a first screen and a second screen that extend along the light source and are connected to the motor means wherein the motor means moves the first screen and the second screen to desired positions alongside the light source.

The present invention pertains to a lighting apparatus for a building structure. The apparatus comprises a light source. The apparatus comprises a screen disposed in spaced relation with the light source and adjacent the light source. The screen having a first lamella and a second lamella, and an opening. The apparatus comprises a motor connected to the first lamella and the second lamella, wherein the motor moves the first lamella and the second lamella in relation to each other to control light from the light source emitting from the hole by controlling positioning of the first lamella and the second lamella over the opening.

The present invention pertains to a lighting apparatus. The apparatus comprises a housing having a base and a wall extending from the base which defines an enclosure. The apparatus comprises a pivotable mount disposed in the enclosure. The apparatus comprises a light source disposed in the mount. The apparatus comprises a telescoping elongate element which extends from the mount. The element having a free end. The apparatus comprises a reflector attached to the free end of the element, wherein the reflector and the light source disposed on the mount in fixed relation through the element so the light from the light source always reflects from the reflector.

The present invention pertains to an apparatus for lighting a room from a wall or ceiling of the room. The apparatus comprises a light source. The apparatus comprises an alcove disposed behind a wall or ceiling. The light source disposed within the alcove. The alcove having an opening that communicates with the room. The apparatus comprises a reflector disposed in the room outside the alcove and positioned to reflect light admitted from the light source.

The present invention pertains to an apparatus for lighting a building structure. The apparatus comprises a generator having a plurality of lights arranged in a radial configuration. The apparatus comprises an attachment for holding the generator to the building structure. The apparatus comprises a linear reflector in spaced relation to the generator and positioned about the building structure in alignment with the generator to reflect light from the light source.

The present invention pertains to an apparatus for lighting a building structure. The apparatus comprises a light source. The apparatus comprises a translucent tube that is disposed to capture light emitted from the light source at a first end of the tube to create a soft general light effect from the tube. The apparatus comprises a reflector disposed in proximity to a second end of the tube to reflect light from the light source that has passed through the tube.

The present invention pertains to a lighting apparatus for a building structure. The apparatus comprises a first elongate profile having an enclosure. The apparatus comprises a second elongate profile having an enclosure. The apparatus comprises an attachment connected to the first and second elongate profiles to hold the first and second elongate profiles to the building structure. The apparatus comprises a plurality of movable lamps disposed in the enclosure of the first and second elongate profiles. The apparatus comprises a plurality of reflectors connected to the attachment and in spaced relationship with the lamps, wherein the light emitted from the lamps is reflected by the reflectors.

The present invention pertains to an apparatus for lighting a room from a wall or ceiling of the room. The apparatus comprises a light source which emits light. The apparatus comprises an alcove disposed behind the wall or ceiling. The light source disposed within the alcove. The alcove having an opening that communicates with the room. The apparatus comprises reflectors disposed in the alcove and positioned adjacent the light source to reflect the light from the light source through the opening into the room.

1. Installation Freedom.

The use of reflecting elements instead of lamps, allows installation within total liberty. Light beams can come from anywhere, regardless the surface texture, the accessibility of the source or the availability of electrical wiring.

2. Visual Comfort.

Practically all classic light sources will cause visual discomfort within a wide angle around the beam; this is the result of the fall-off light coming directly from the burner inside the lamp, or because of secondary reflections inside the lamp's reflector.

A hidden light source that projects its light onto a separate reflector will only cause blinding when one is looking back into the beam.

3. Saving Light.

Some IRS applications allow to use small fractions of a larger light beam to create separate lighting accents. There is no need for using extra light sources to accomplish this effect.

4. Flexible Atmospheres.

Several IRS applications can generate atmosphere changements. One way to do this is with motorized movements that create uplight/downlight or direct/indirect shifting. Another way is 'multiple sourcing': two or more different source types work together with one reflector, alternately projecting different types of light into the space from the same location.

5. Maintenance and Relamping.

Obviously, the use of reflecting surfaces in locations where normally the lamps should be, creates a chance to put the light sources within reach. This is especially interesting in high and wide spaces.

6. Safe Lighting.

Also, when on the contrary the lamps should be beyond reach (for instance, to prevent injury or damage caused by high temperatures), IRS can solve this problem by a distant source that projects its light onto a reflector within reach.

7. Architectural Uniformity.

When the architecture of a space or a building requires a maximum integration of the lighting, IRS offers particular advantages. Regardless the used source type and the beam direction, the appearance of some IRS concepts remains uniform and discrete. The reflectors can look identical, while the invisibly integrated sources that hit them might differ in size, type and direction.

8. Design-Technical Innovation.

IRS generates new shapes and designs for lighting appliances. It creates an innovative appearance to most of its applications; it is also attractive because of its high level of mechanical technicity, with a special role for the motorized movements in some fixtures.

BRIEF DESCRIPTION OF THE DRAWINGS

In the accompanying drawings, the preferred embodiment of the invention and preferred methods of practicing the invention are illustrated in which.

DETAILED DESCRIPTION

Figure 3:
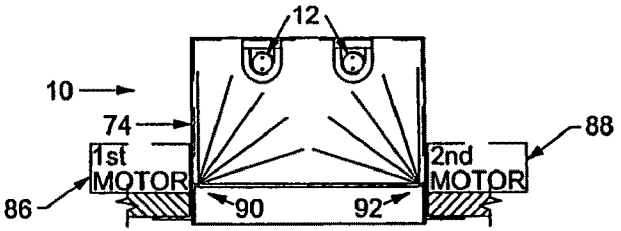
FIG. 3 is an end view of the housing with shutters and a fluorescent lamp source.
Figure 4:
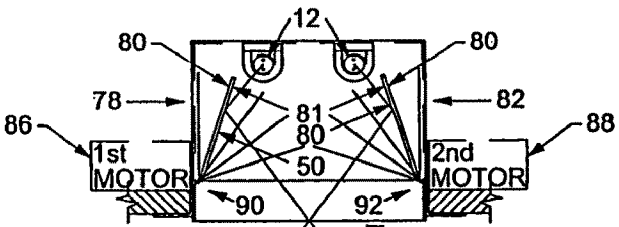
FIG. 4 is an end view of the housing with shutters placed as reflectors.
Figure 5:
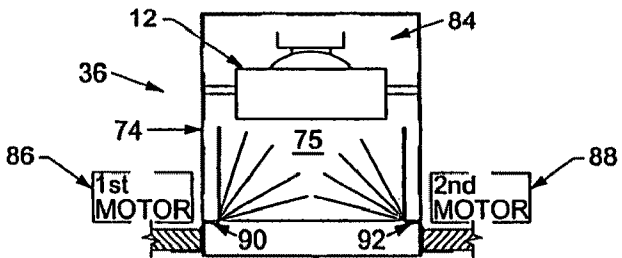
FIG. 5 is an end view of the housing with a lamp source and shutters.
Figure 1:
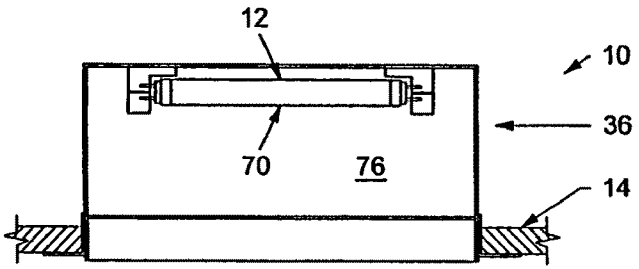
FIG. 1 is a side view of a housing with shutters having a fluorescent lamp source.
Figure 2:
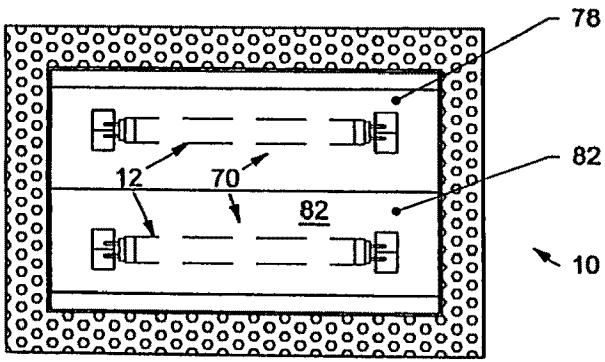
FIG. 2 is a bottom view of a housing with shutters closed to hide the lamp source.
Figure 6:
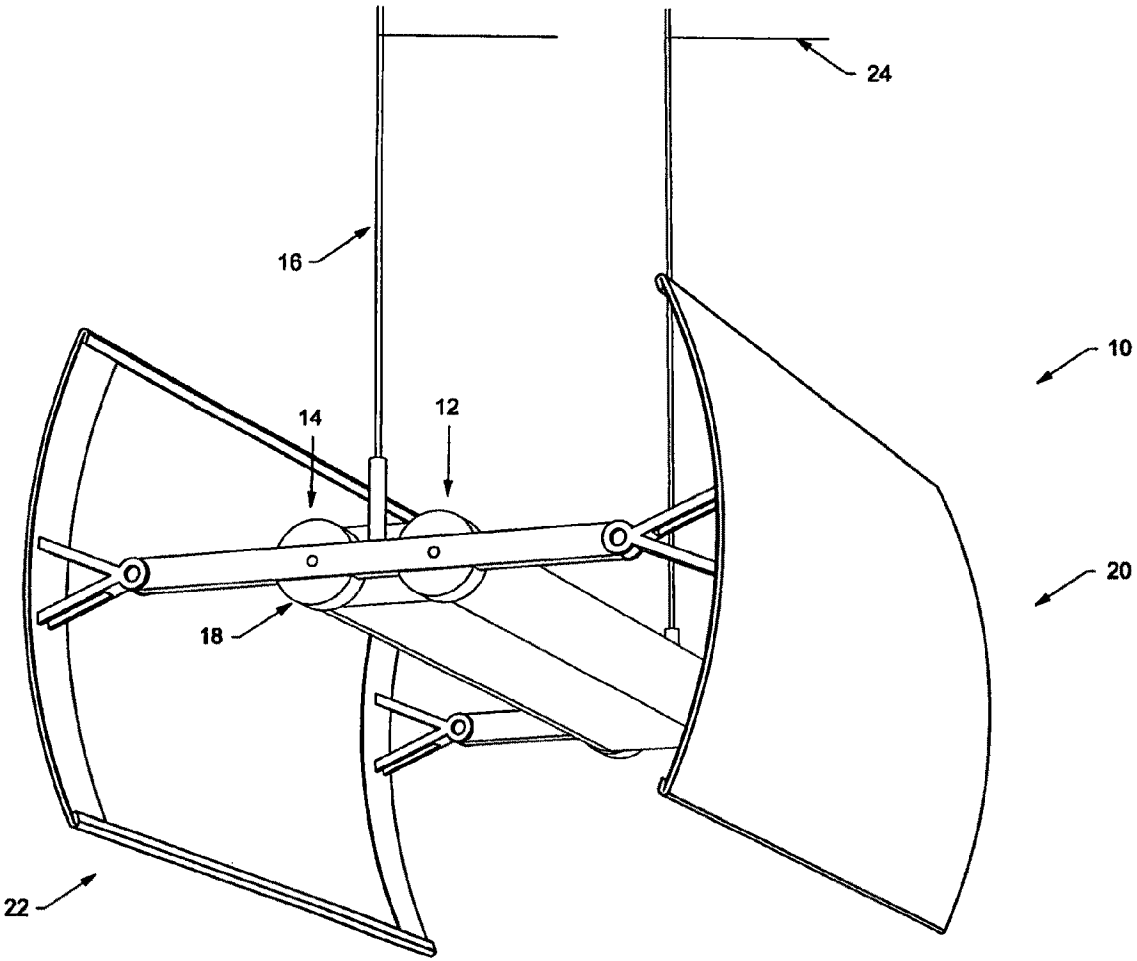
FIG. 6 is a perspective view of a converter.
Figure 7:
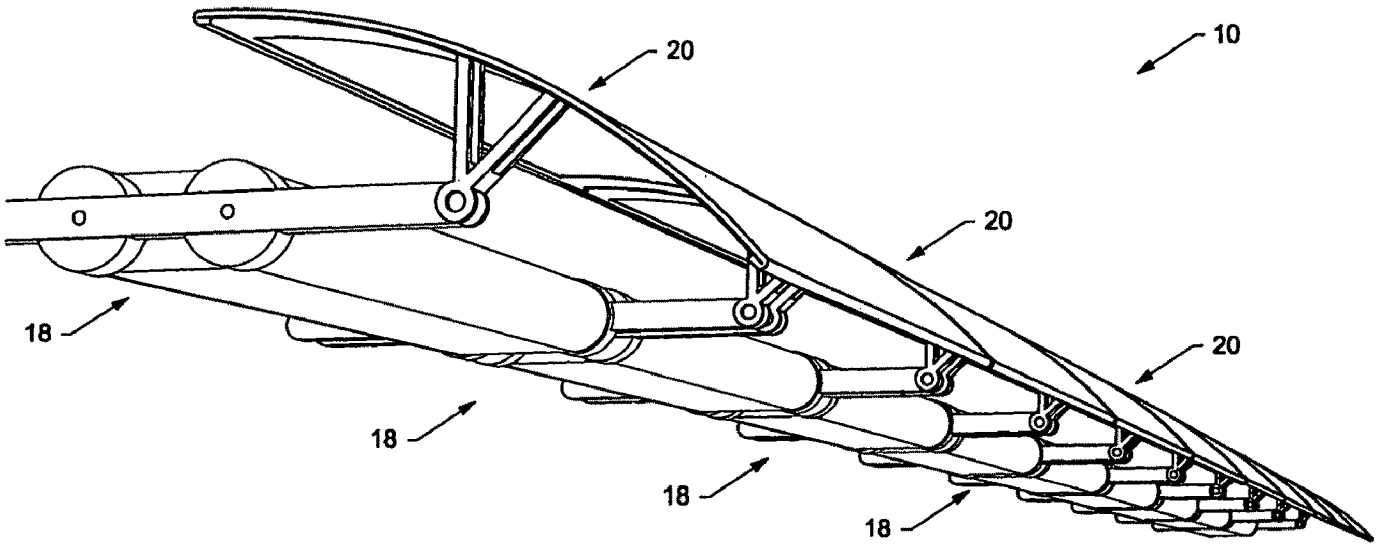
FIG. 7 is a perspective view of a plurality of converters in series.
Figure 8:
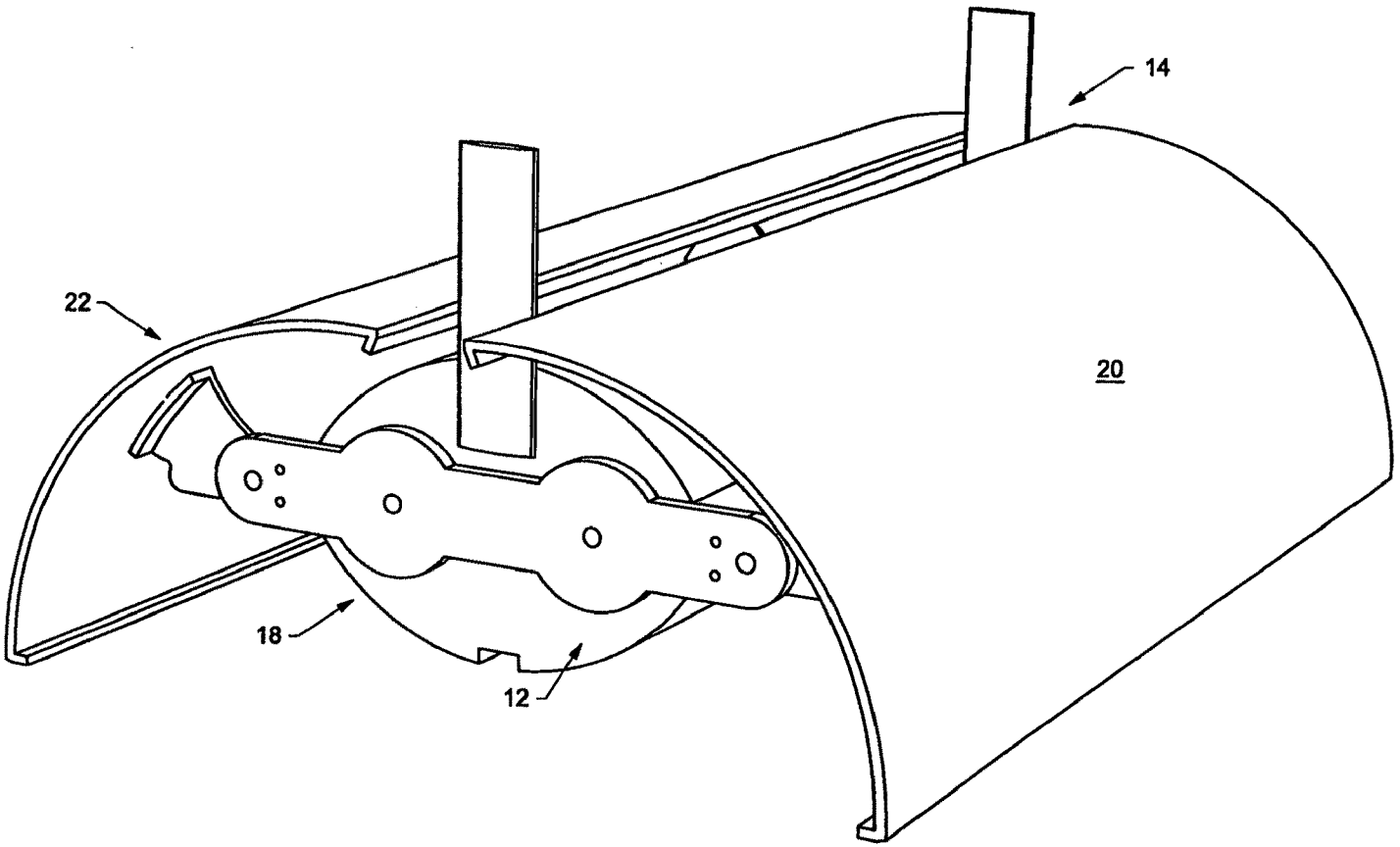
FIG. 8 is a perspective view of a converter in a reflection down position.
Figure 9:
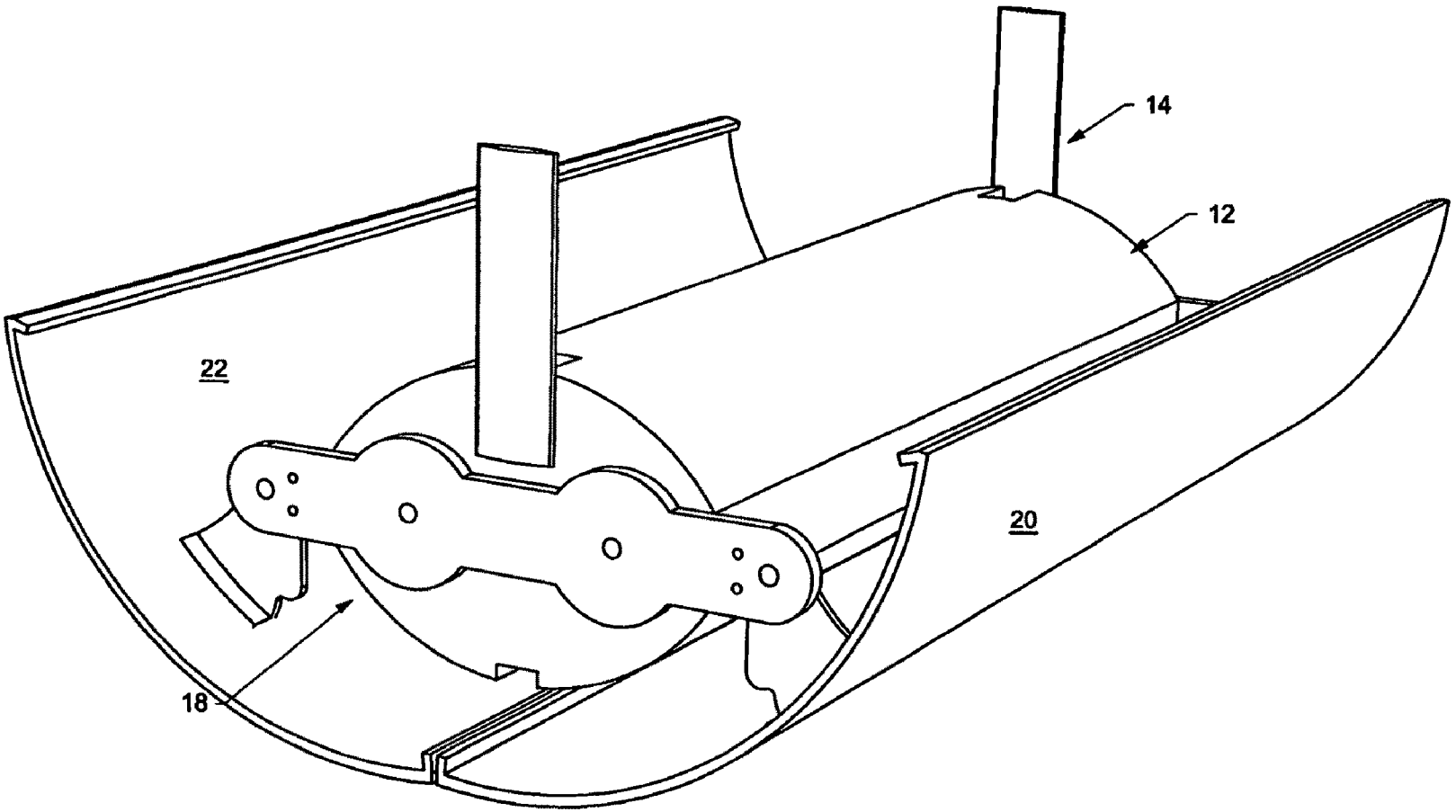
FIG. 9 is a perspective view of a converter in a reflection up position.
Figure 10:
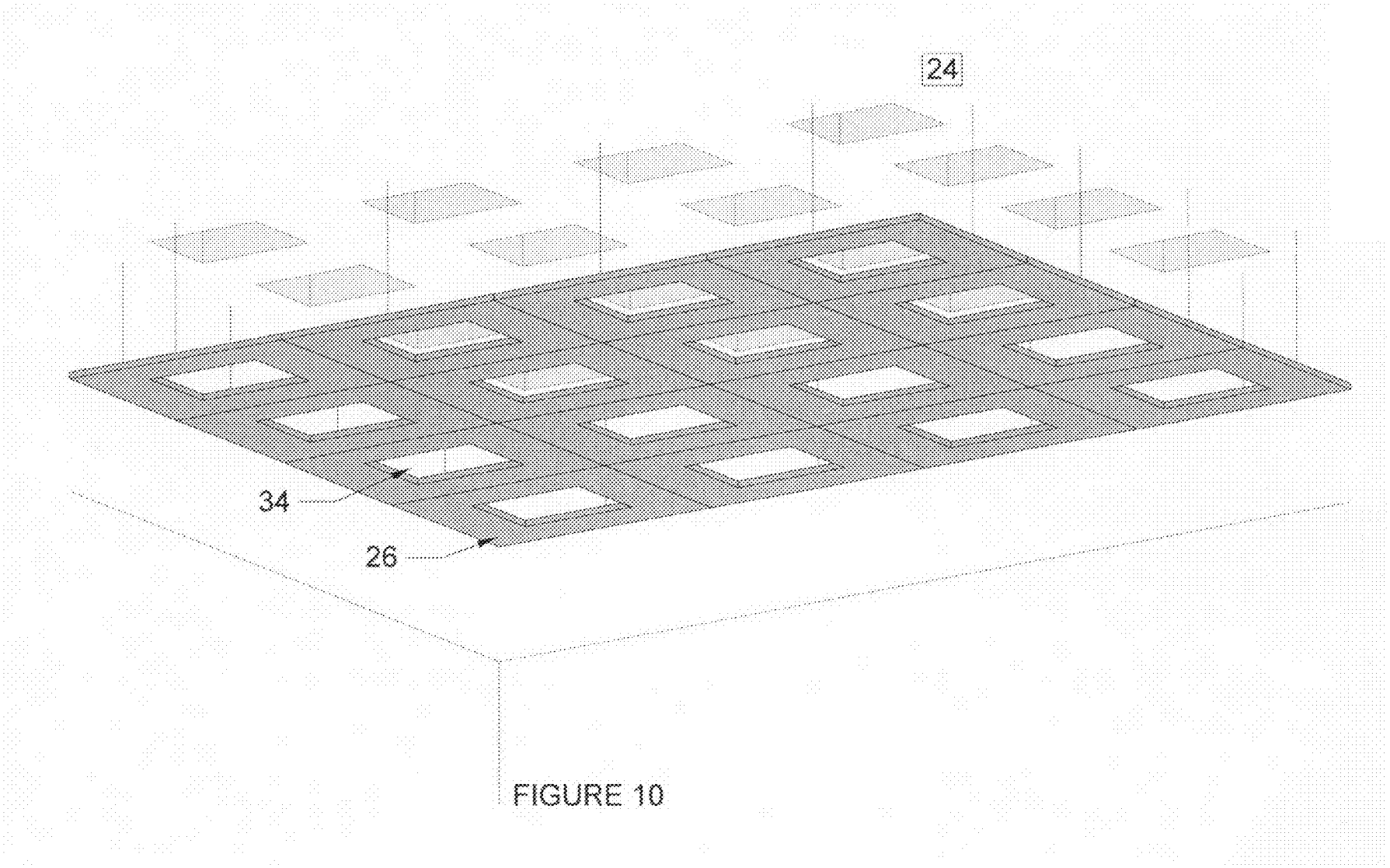
FIG. 10 is a perspective view of a plurality of fragmas in an open state.
Figure 11:
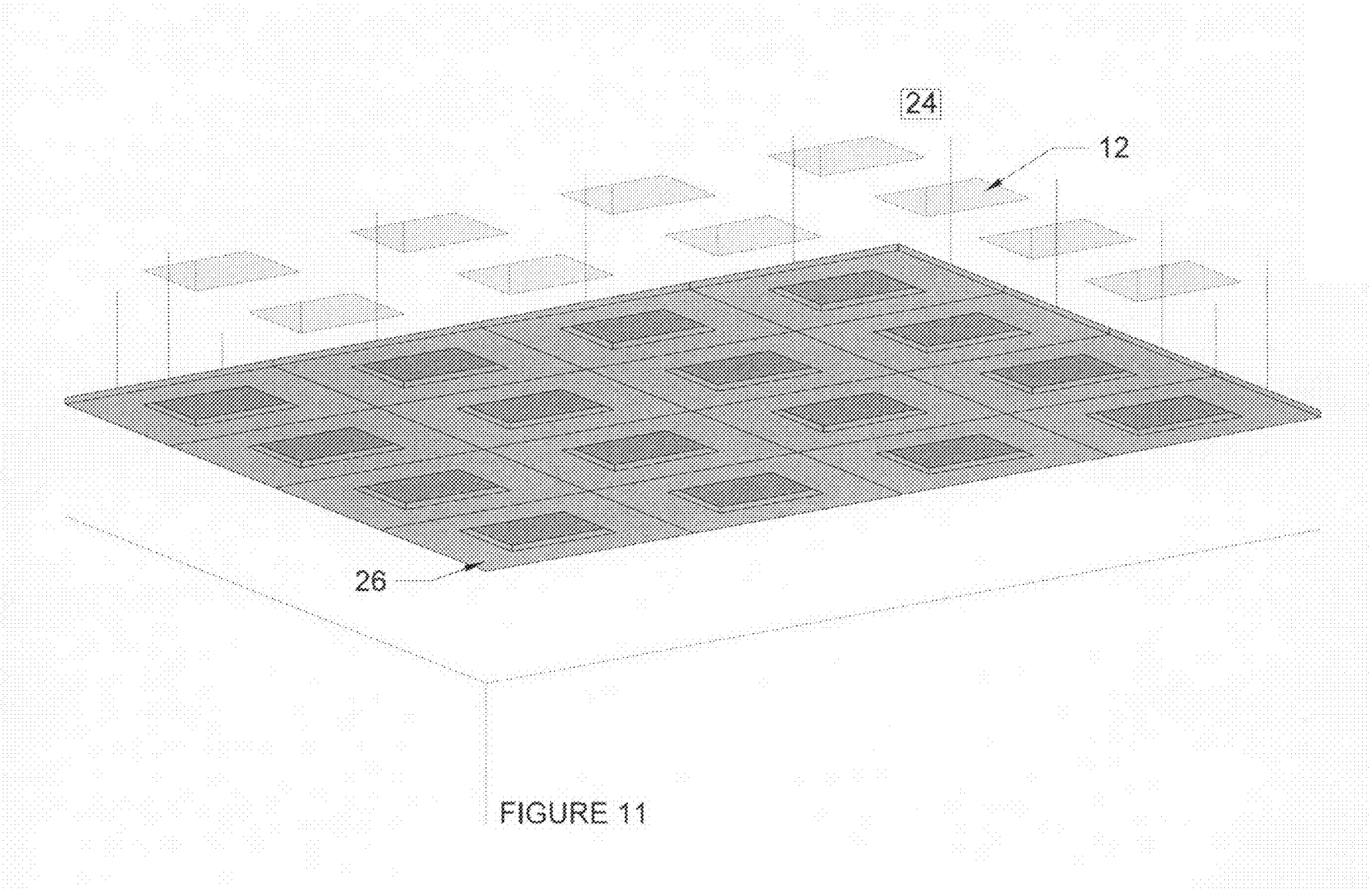
FIG. 11 is a perspective view of a plurality of fragmas in a close state.
Figure 12:
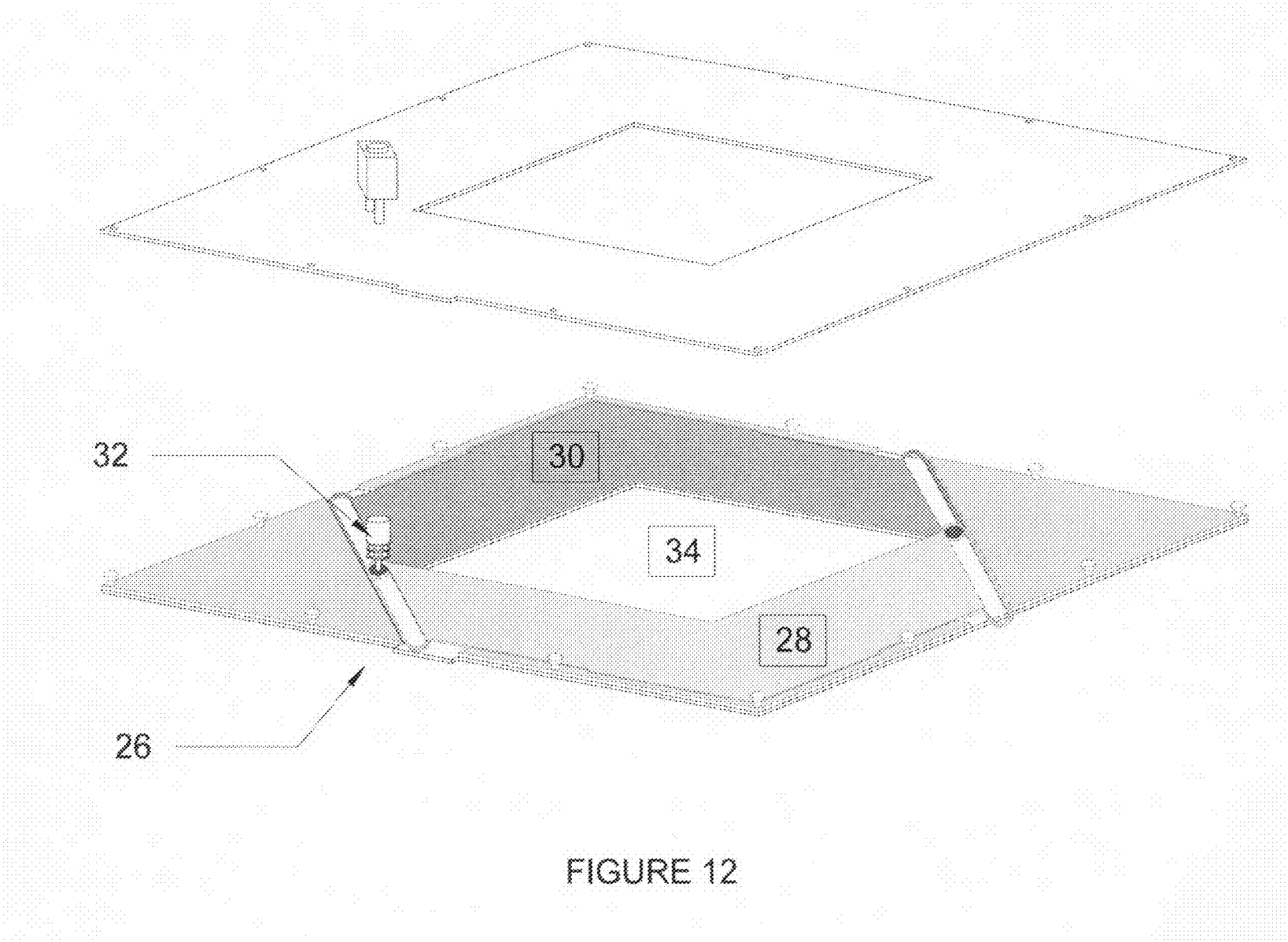
FIG. 12 is an exploded view of a fragma in an open state.
Figure 13:
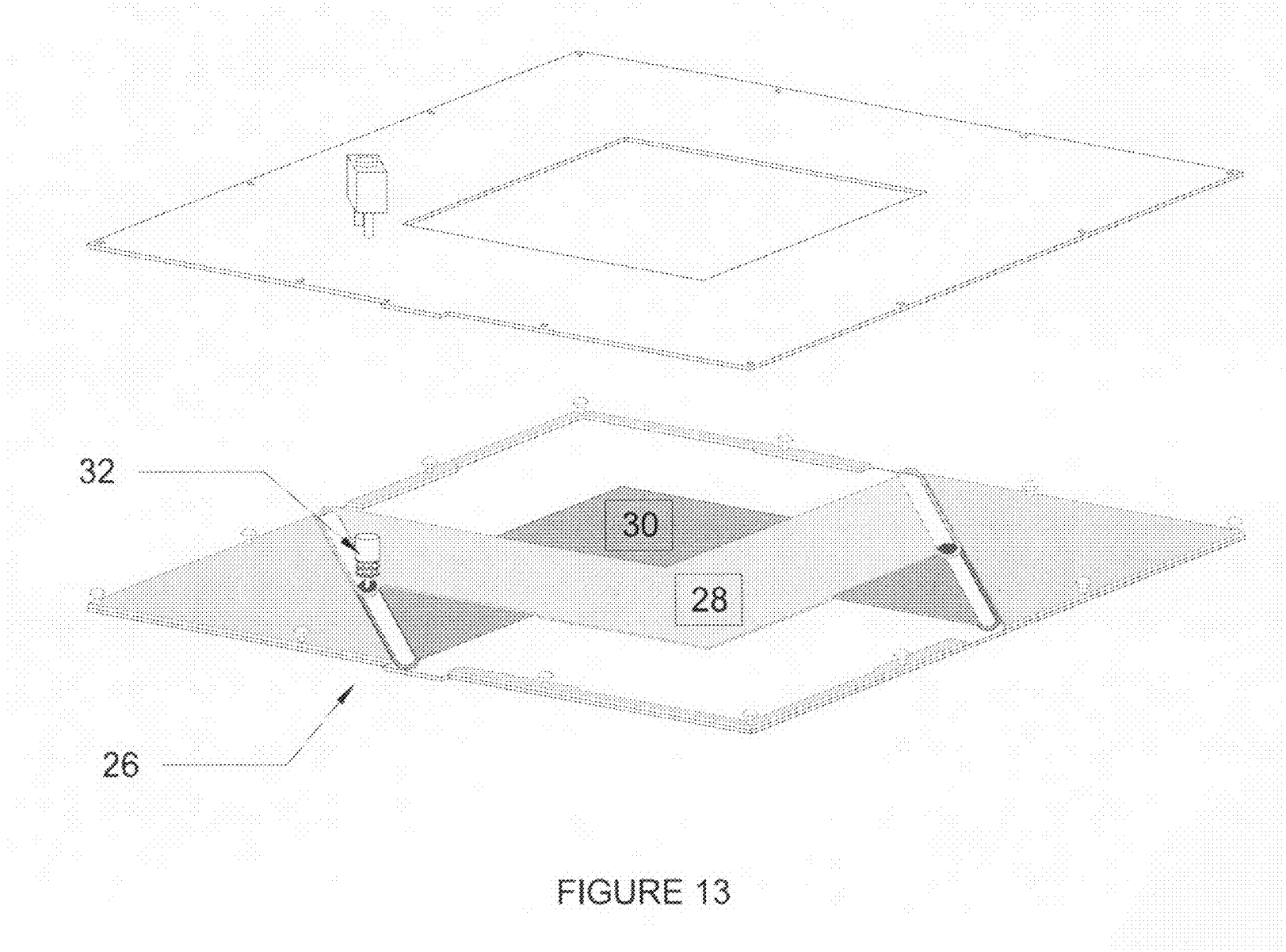
FIG. 13 is an exploded view a fragma in a closed state.
Figure 14:
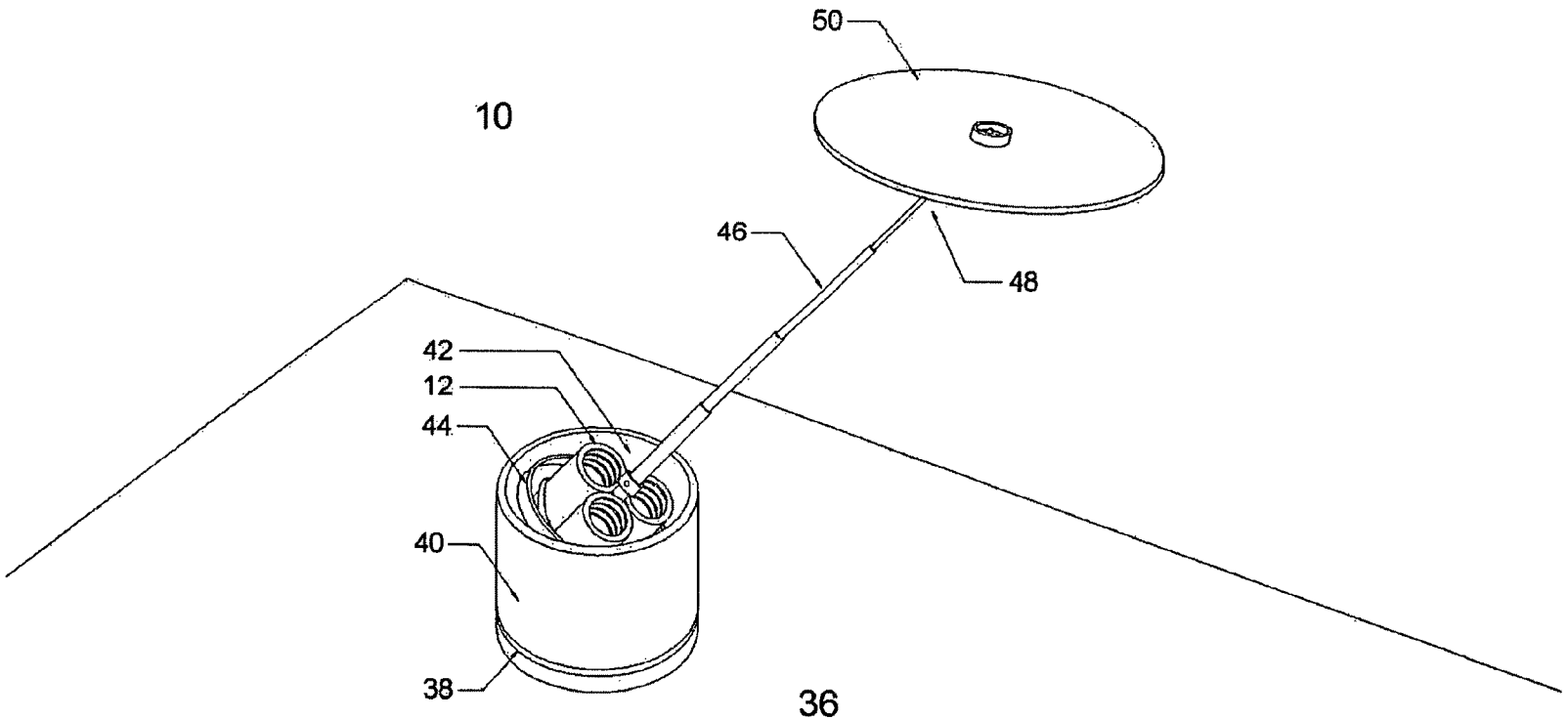
FIG. 14 is a perspective view of a readme.
Figure 15:
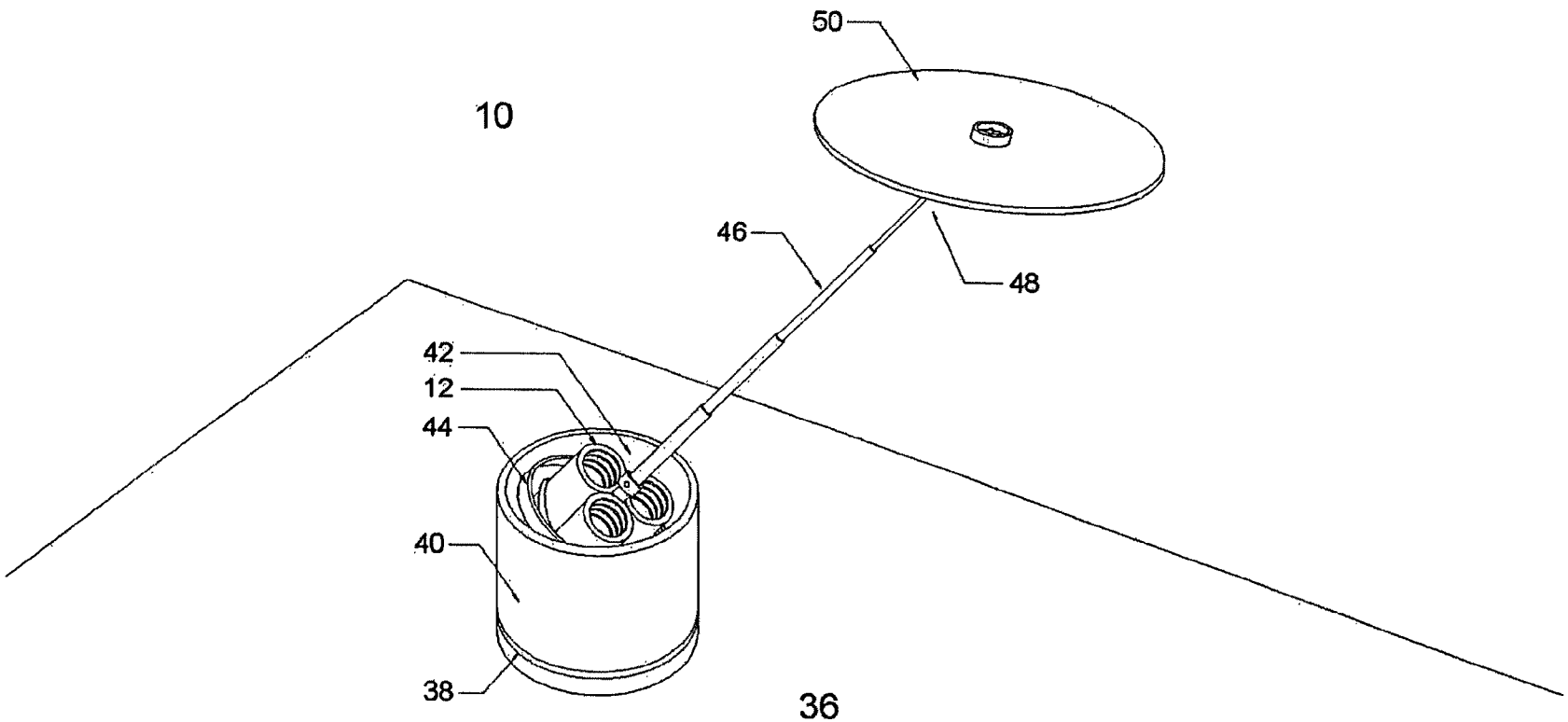
FIG. 15 is a perspective view of a readme.
Figure 16:
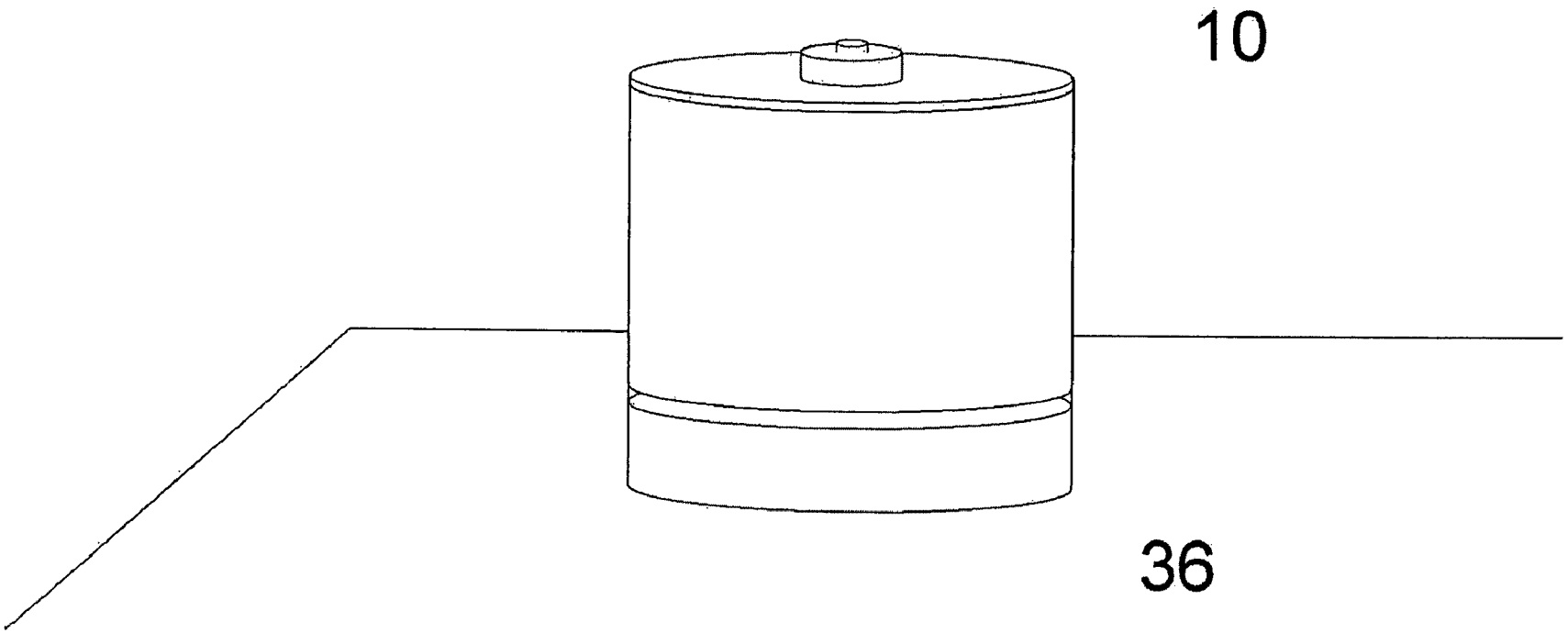
FIG. 16 is a perspective view of a readme in a closed state.
Figure 17:
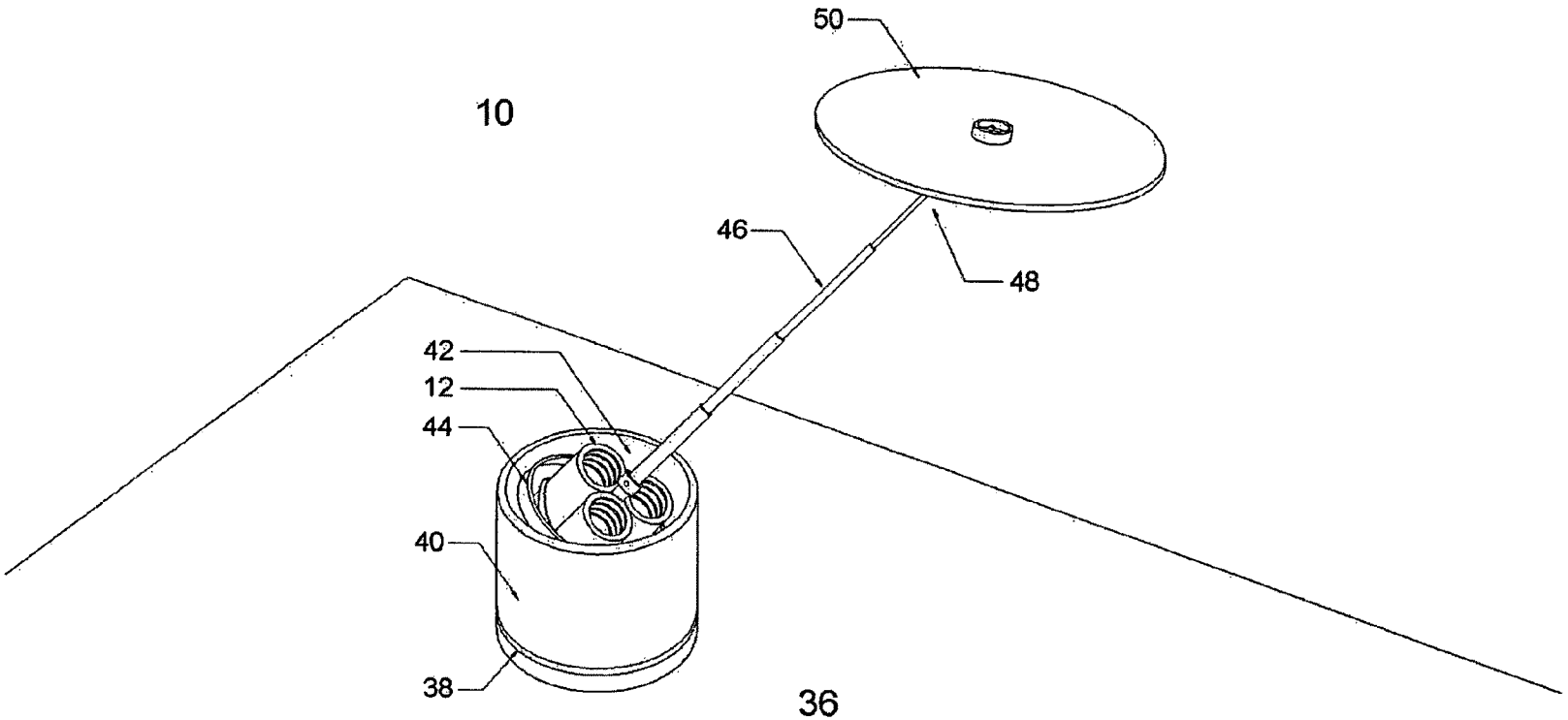
FIG. 17 is a perspective view of a readme with the reflector angled away from the cylinder.
Figure 18:
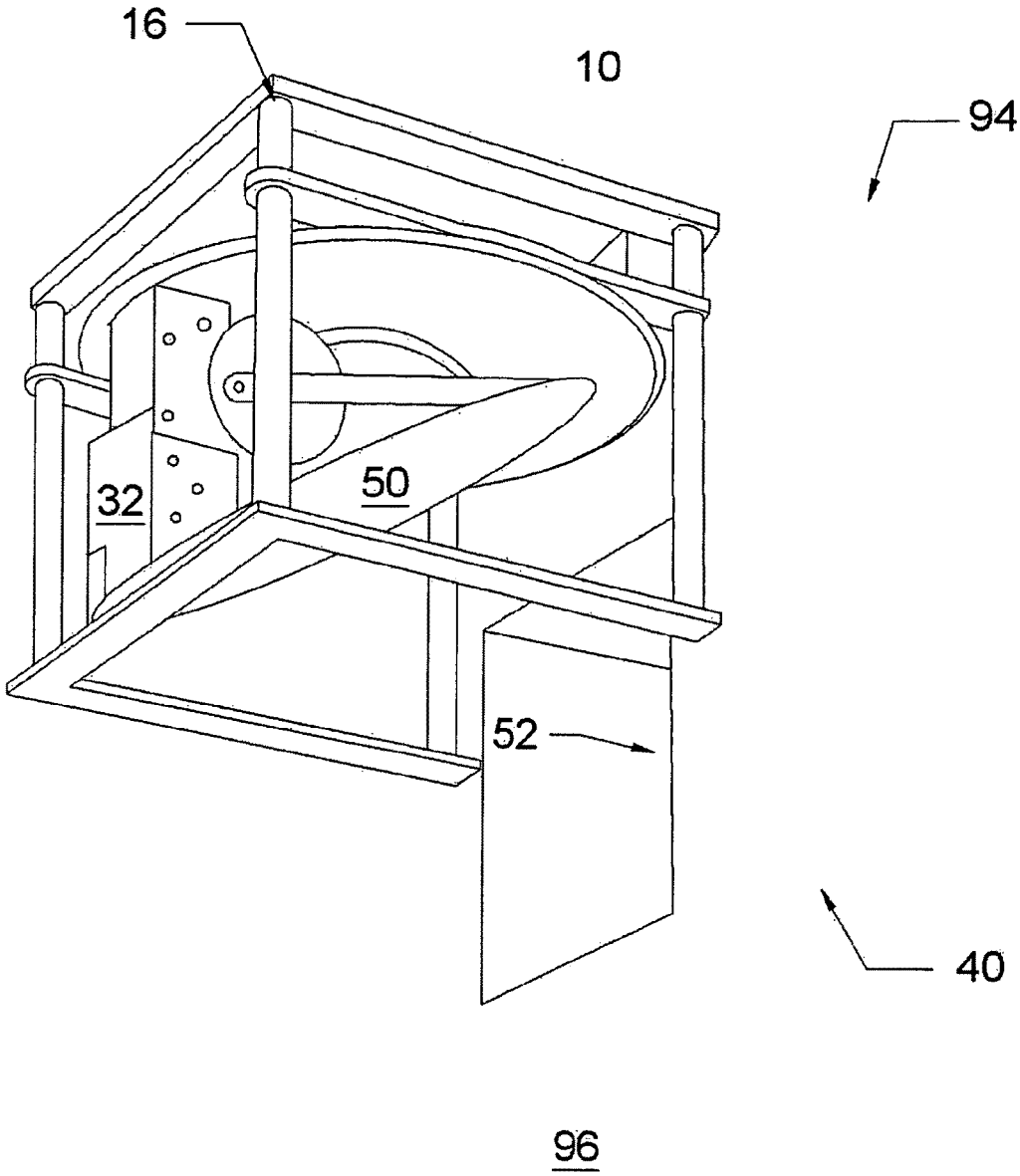
FIG. 18 is a perspective view of an inflector which is motorized.
Figure 19:
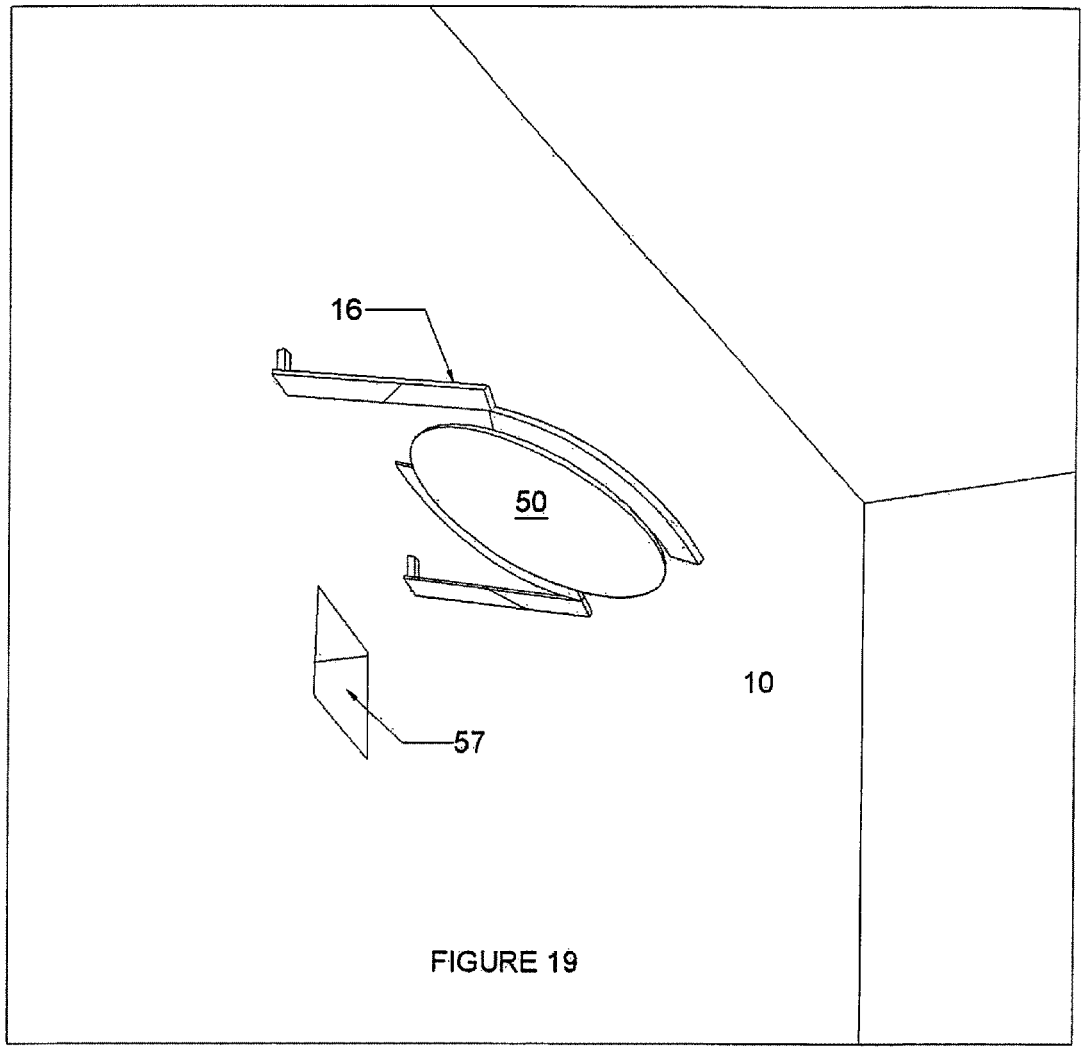
FIG. 19 is a perspective view of an inflector.
Figure 20:
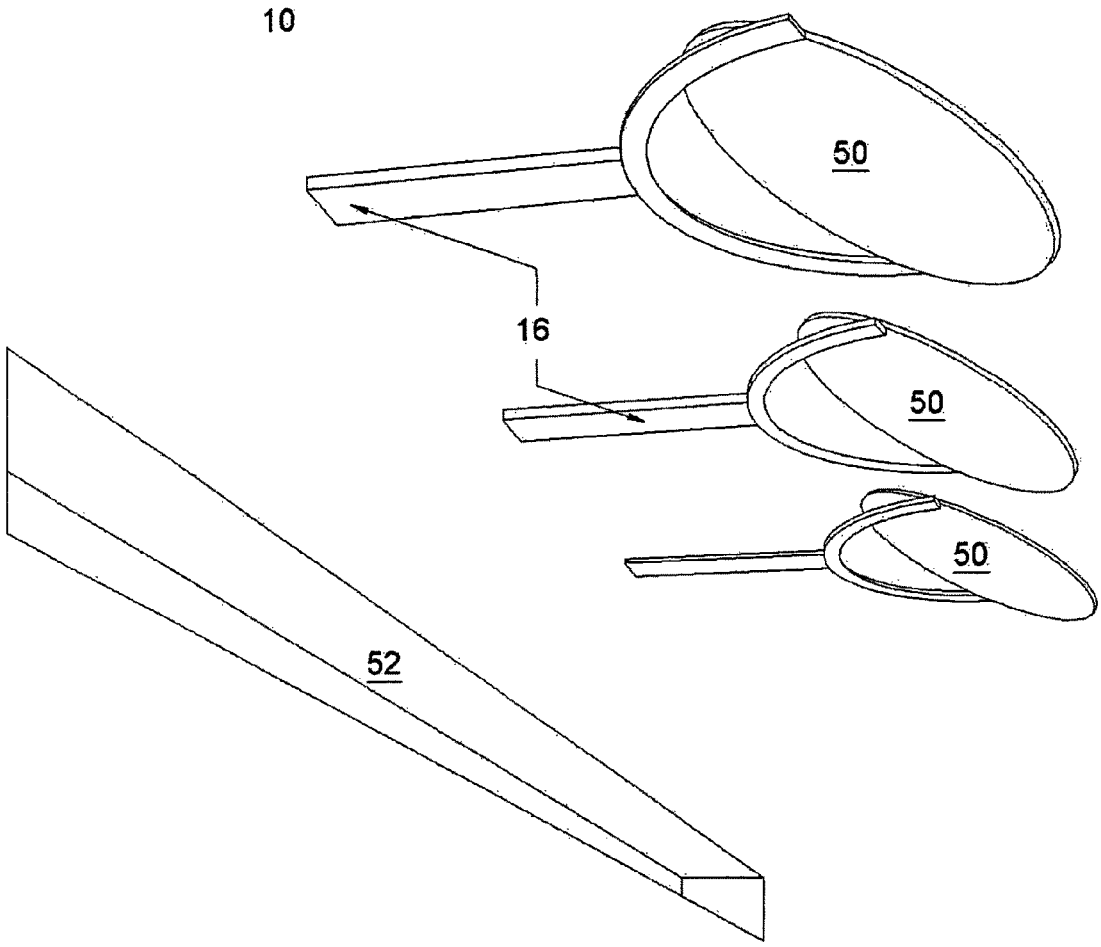
FIG. 20 is a perspective view of a plurality of inflectors.
Figure 21:
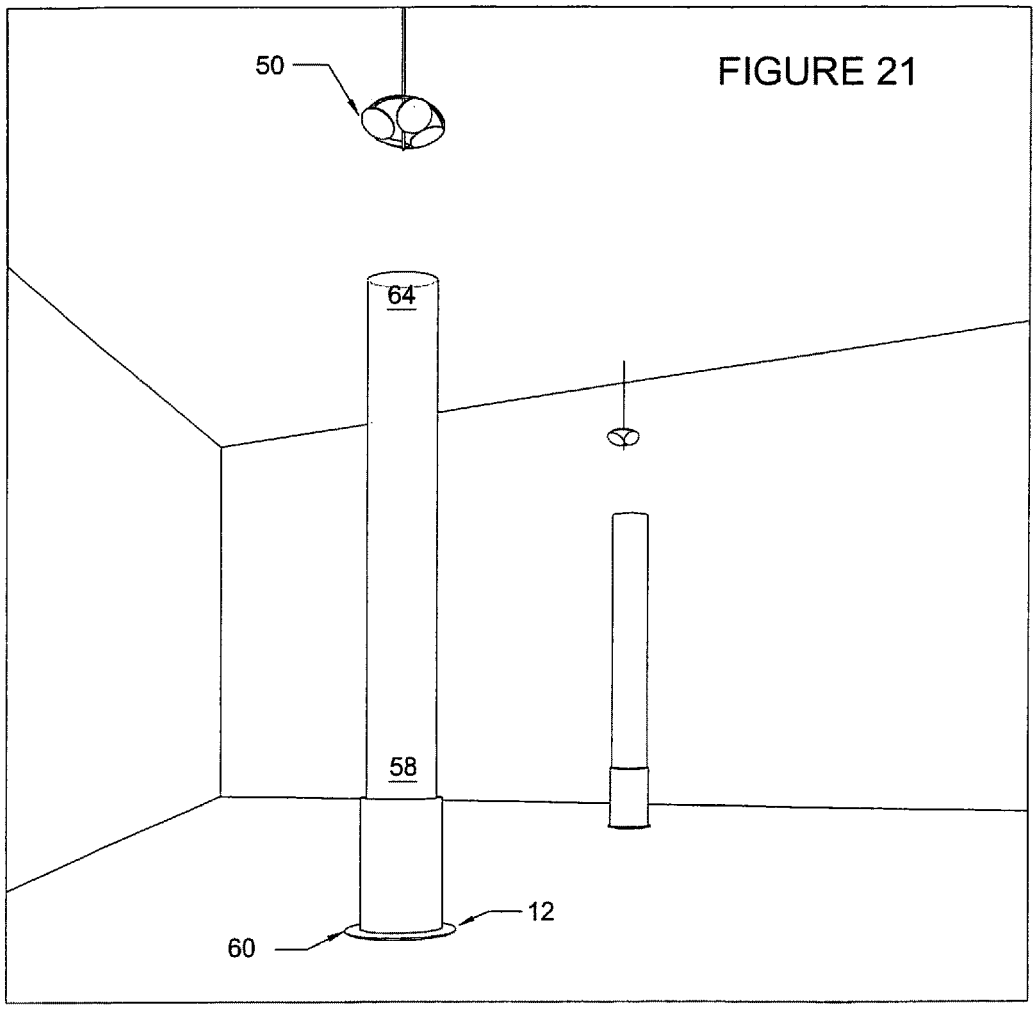
FIG. 21 is a perspective view of an inflector with an opening.
Figure 22:
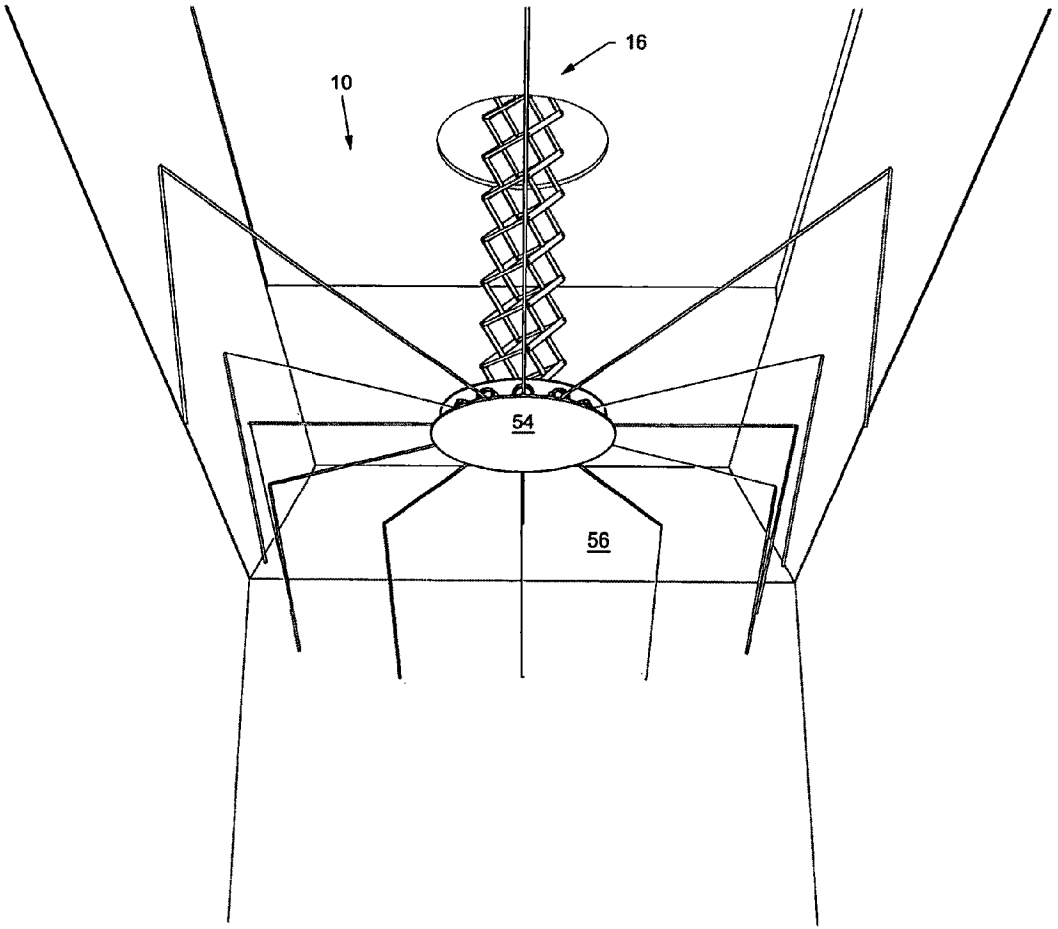
FIG. 22 is a perspective view of the thorax.
Figure 23:
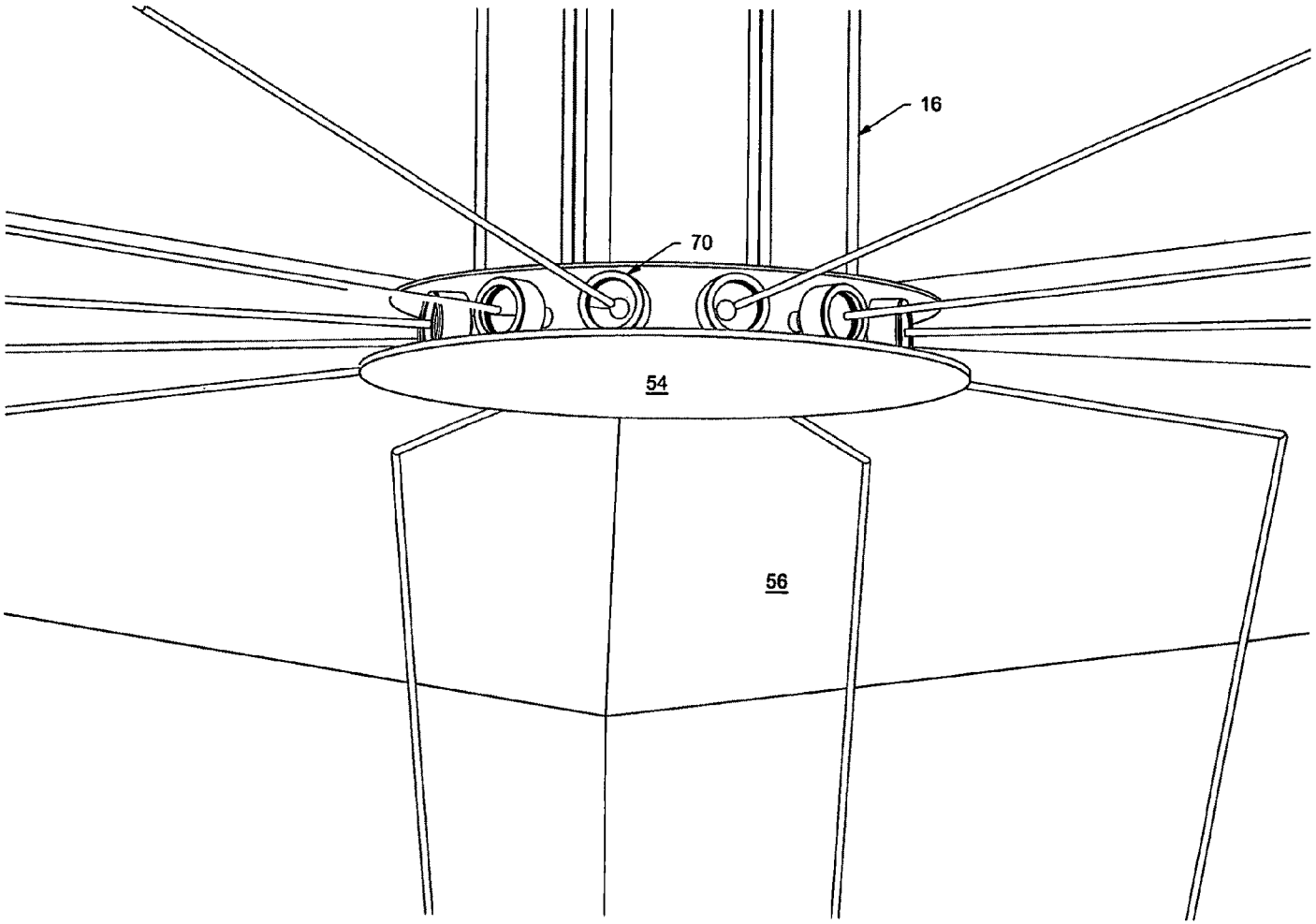
FIG. 23 is a perspective view of the thorax.
Figure 24:
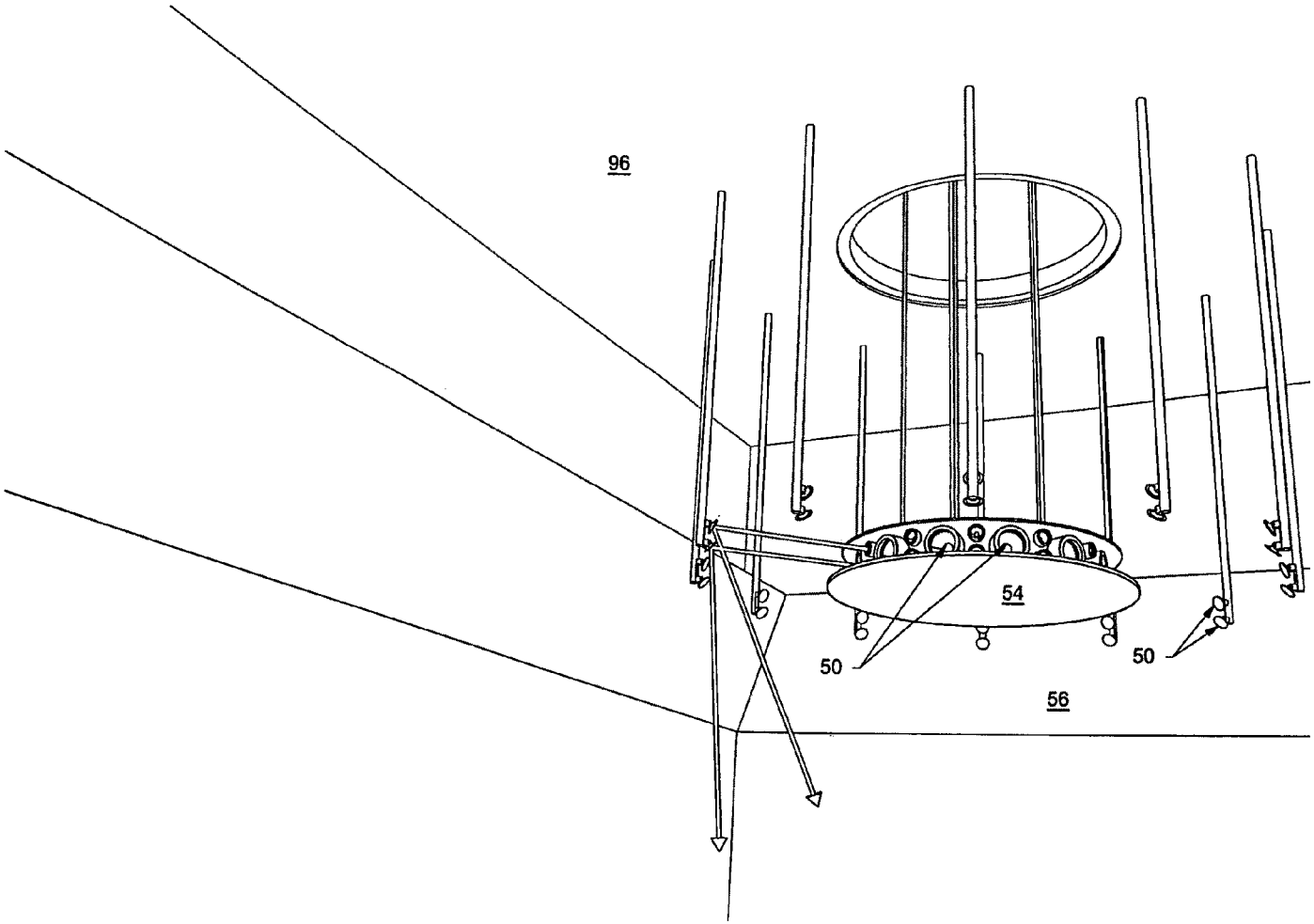
FIG. 24 is a perspective view of a thorax with individual reflectors in addition to the linear reflector.
Figure 25:
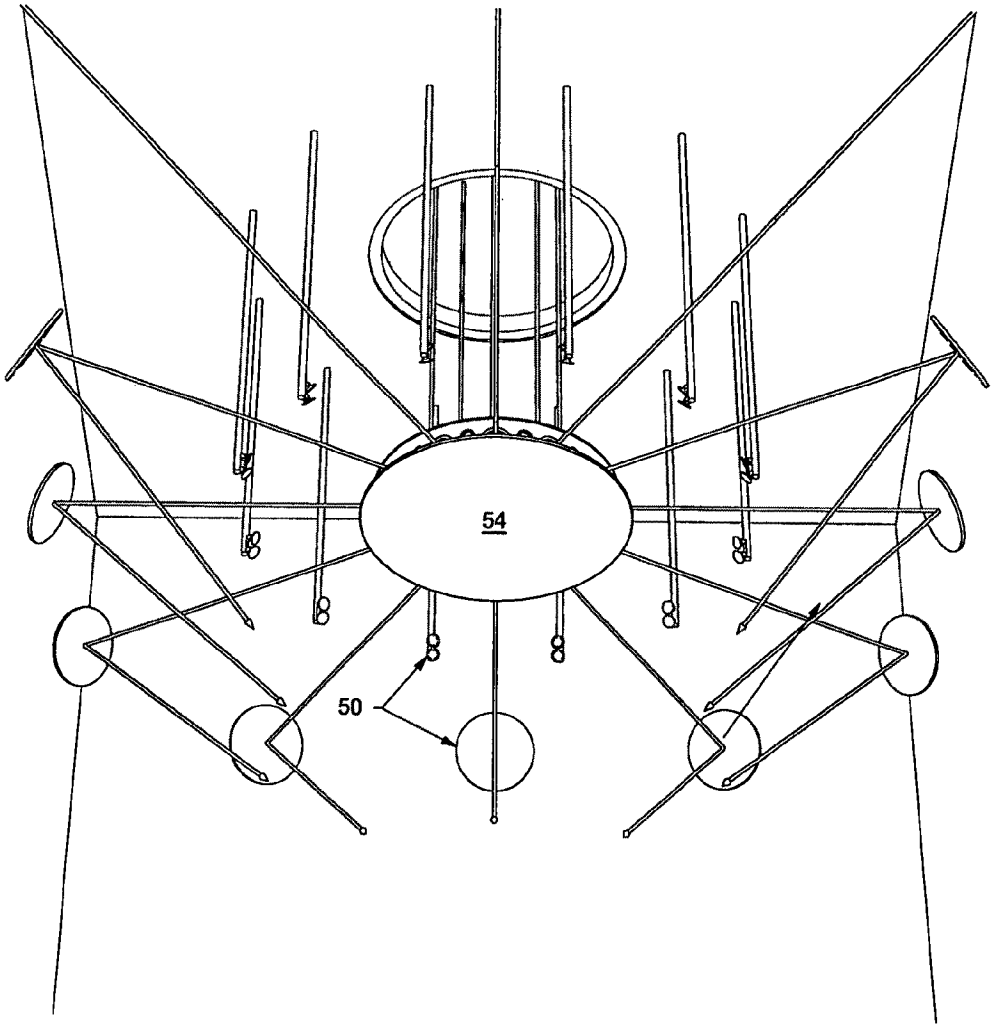
FIG. 25 is a perspective view of another embodiment of a thorax.
Figure 26:
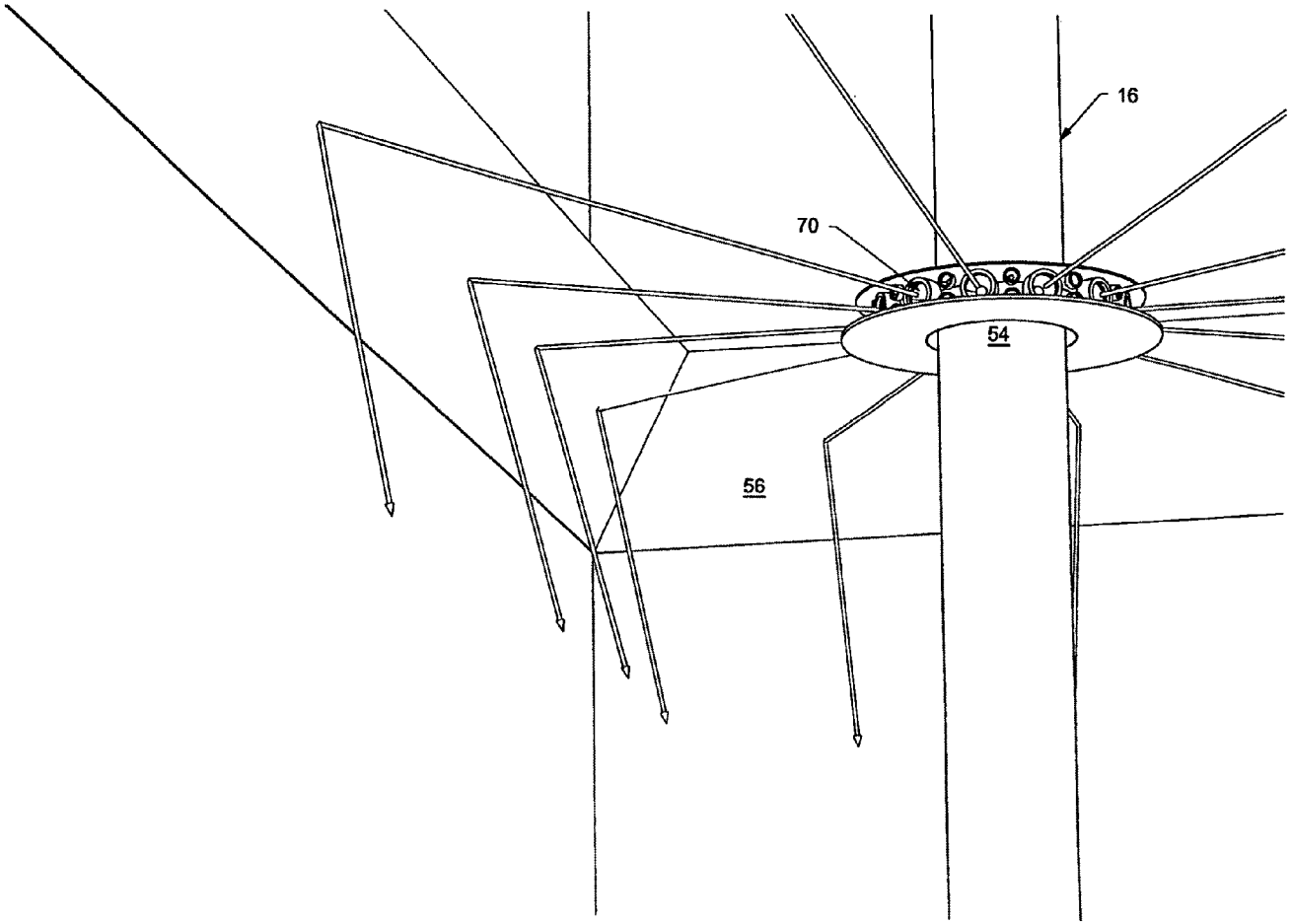
FIG. 26 is a perspective view of yet another embodiment of a thorax.
Figure 27:
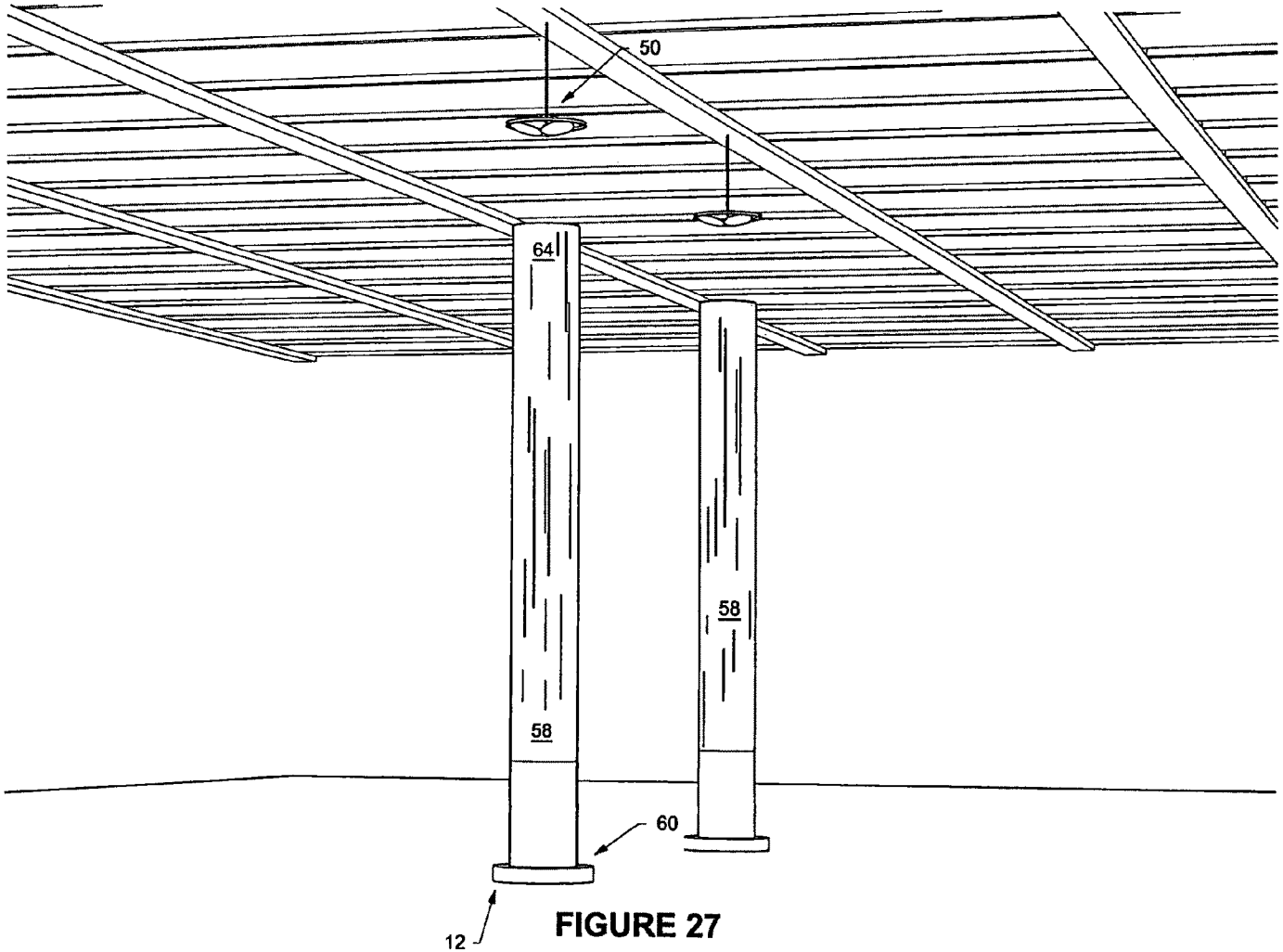
FIG. 27 is a perspective view of a plurality of light cells.
Figure 28:
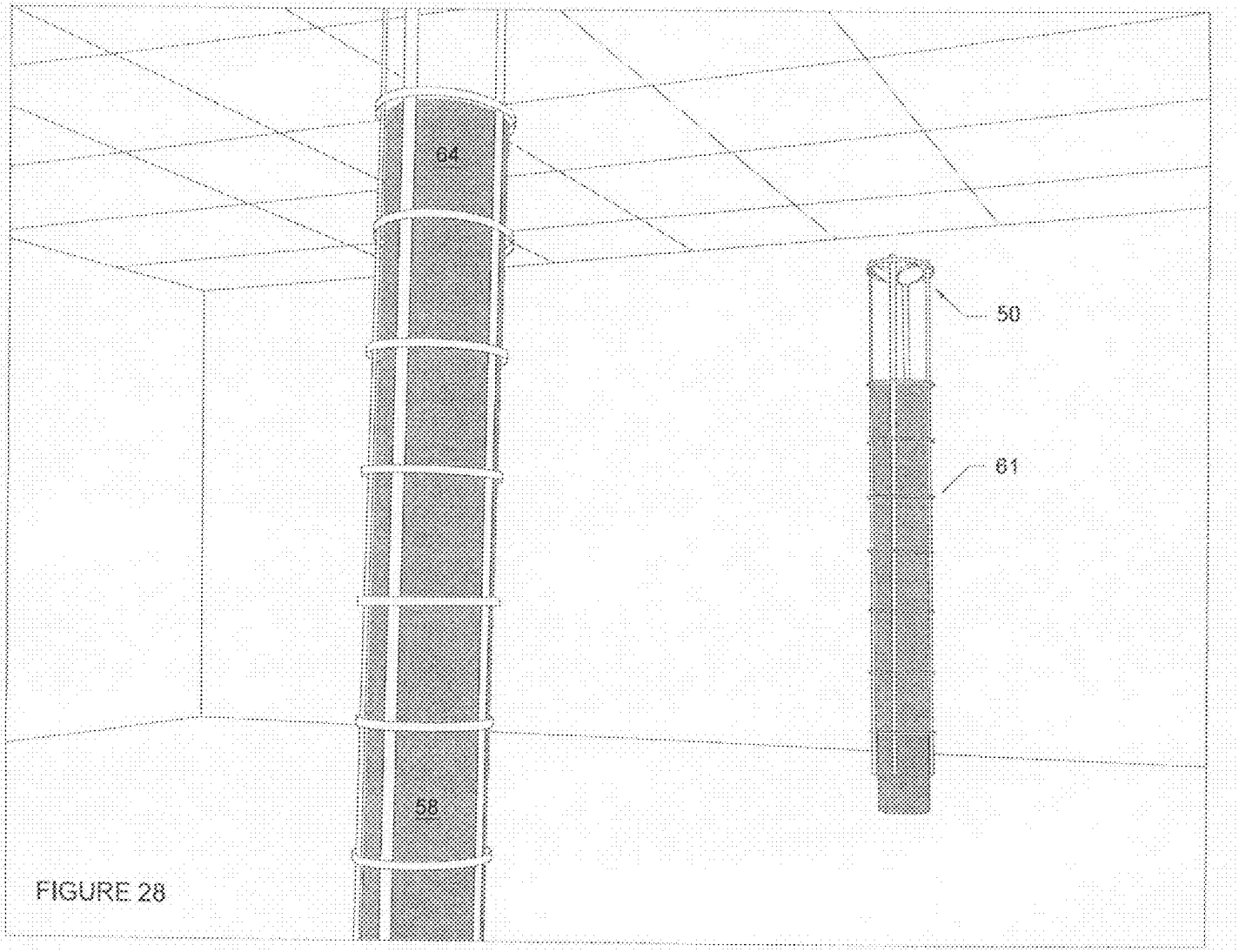
FIG. 28 is a perspective view of a plurality of another embodiment of light cells.
Figure 29:
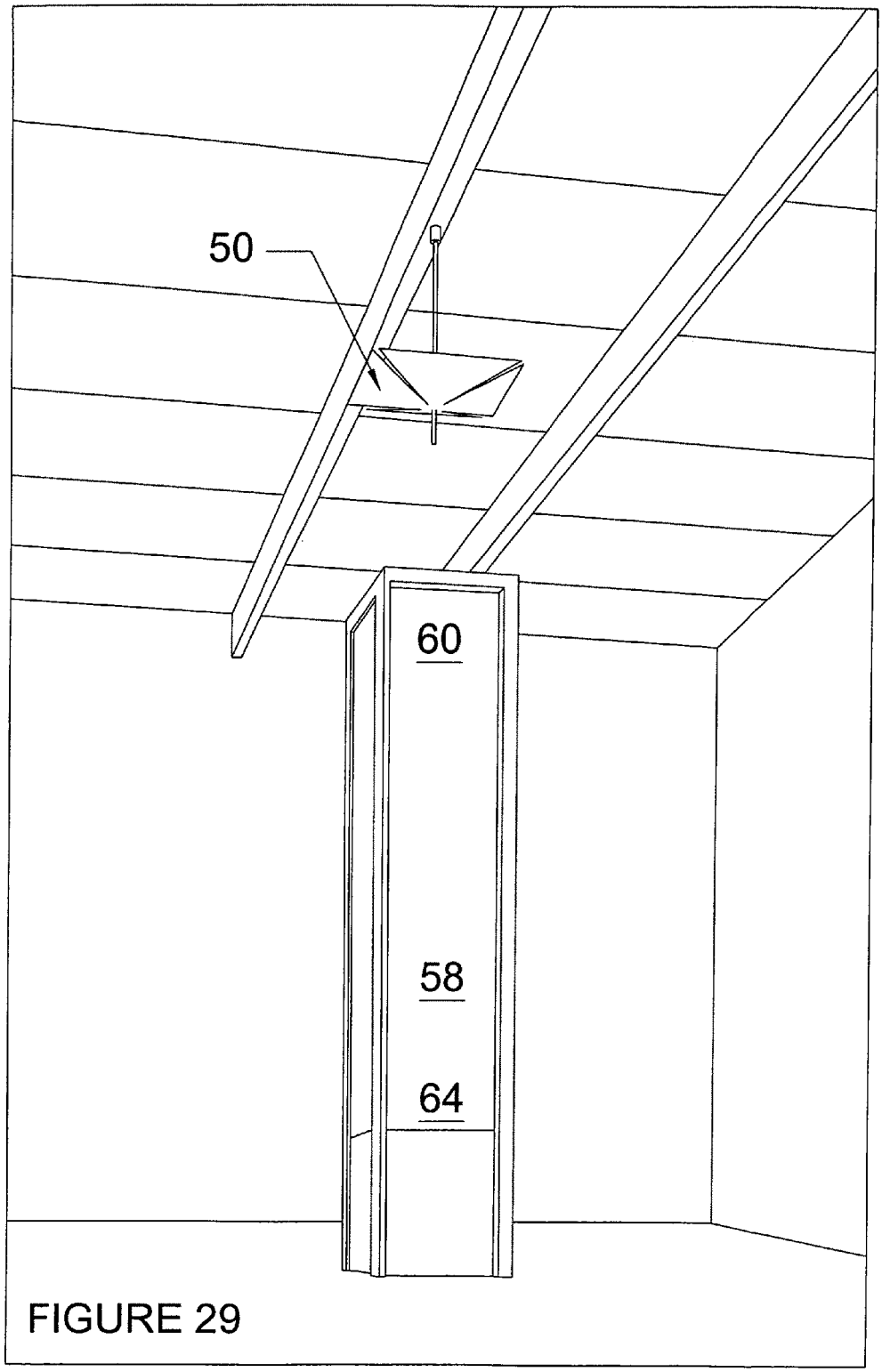
FIG. 29 is a perspective view of another embodiment of a light cell.
Figure 30:
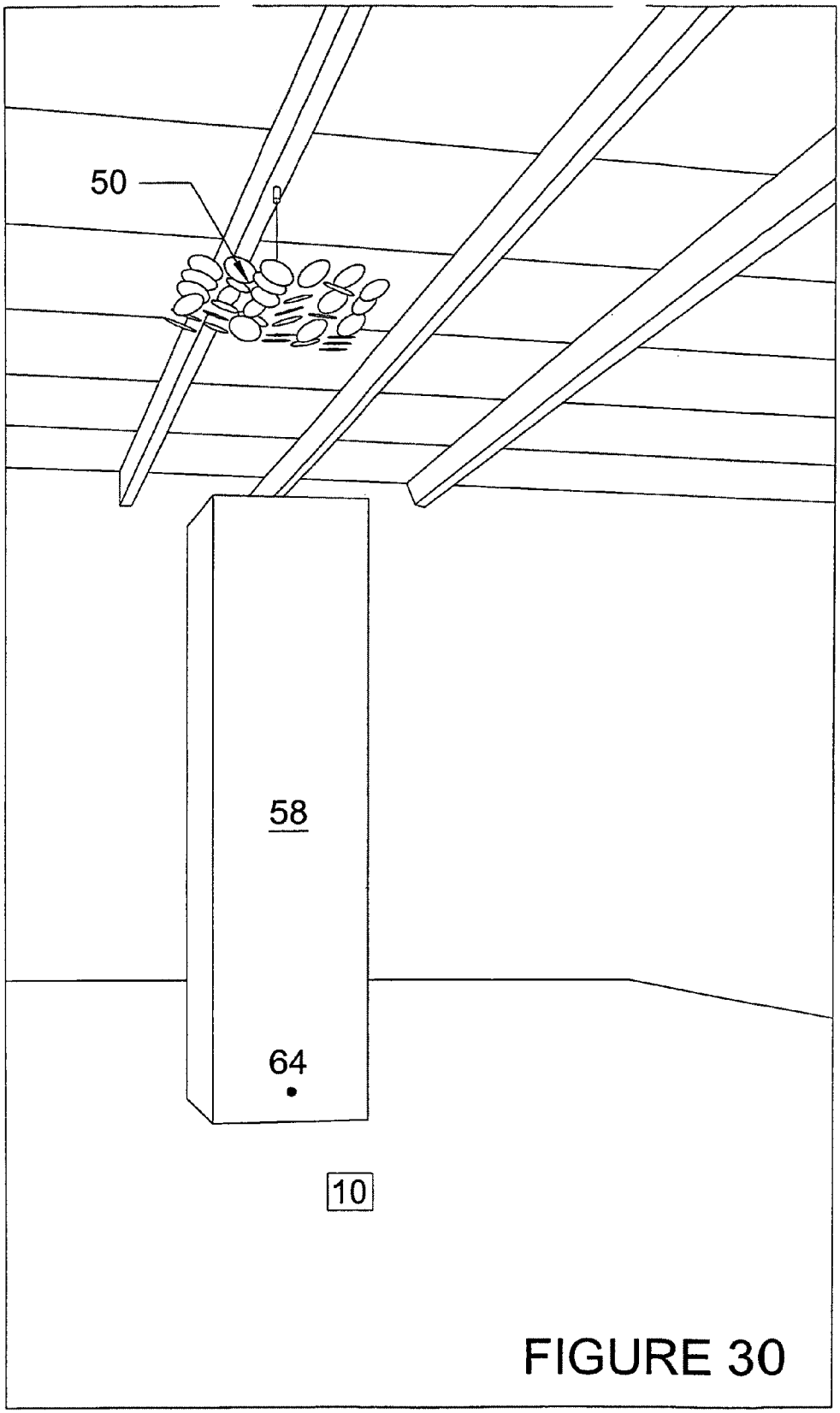
FIG. 30 is another embodiment of a light cell.
Figure 31:
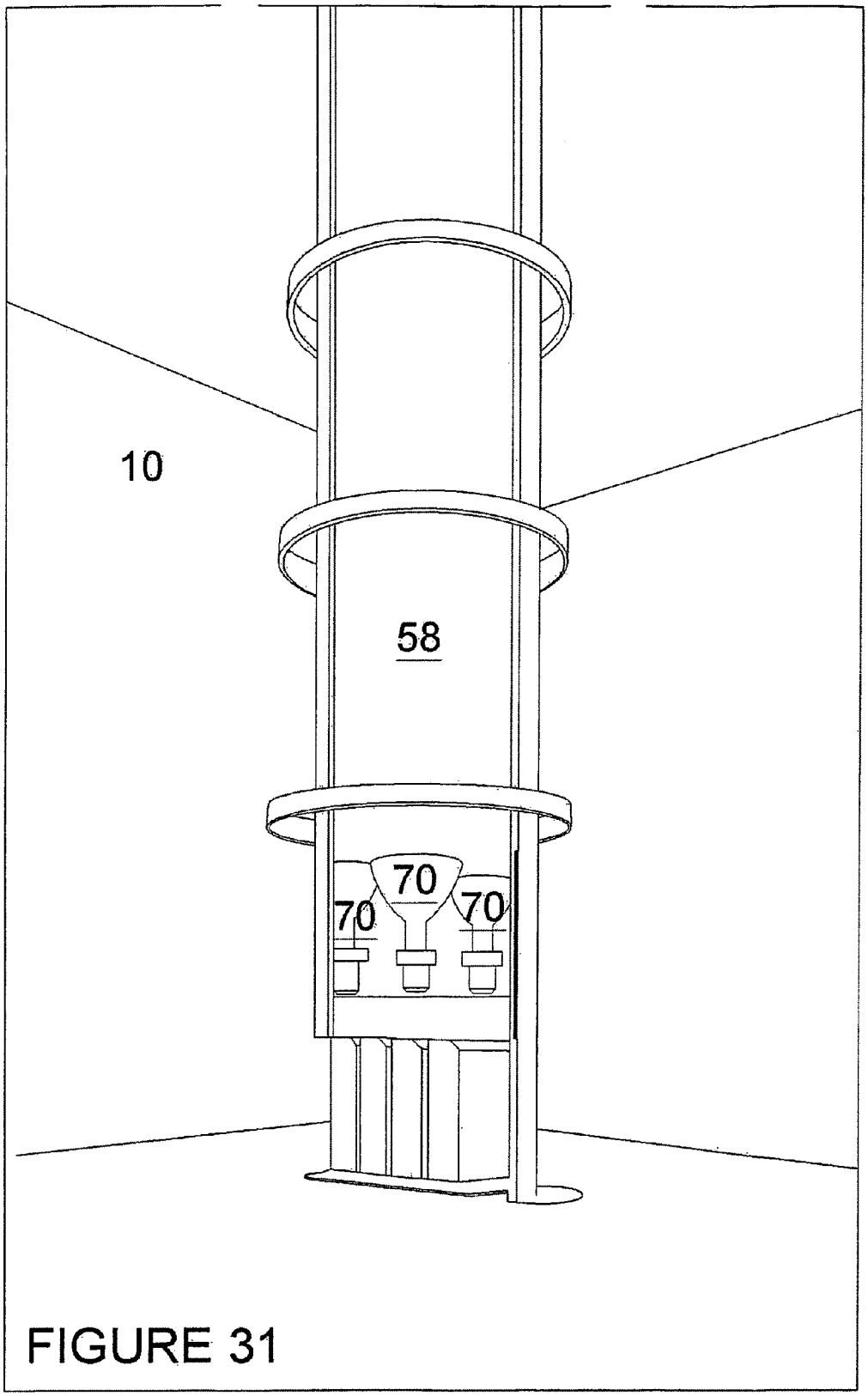
FIG. 31 is a perspective view of all lamps inside a light cell.
Figure 32:
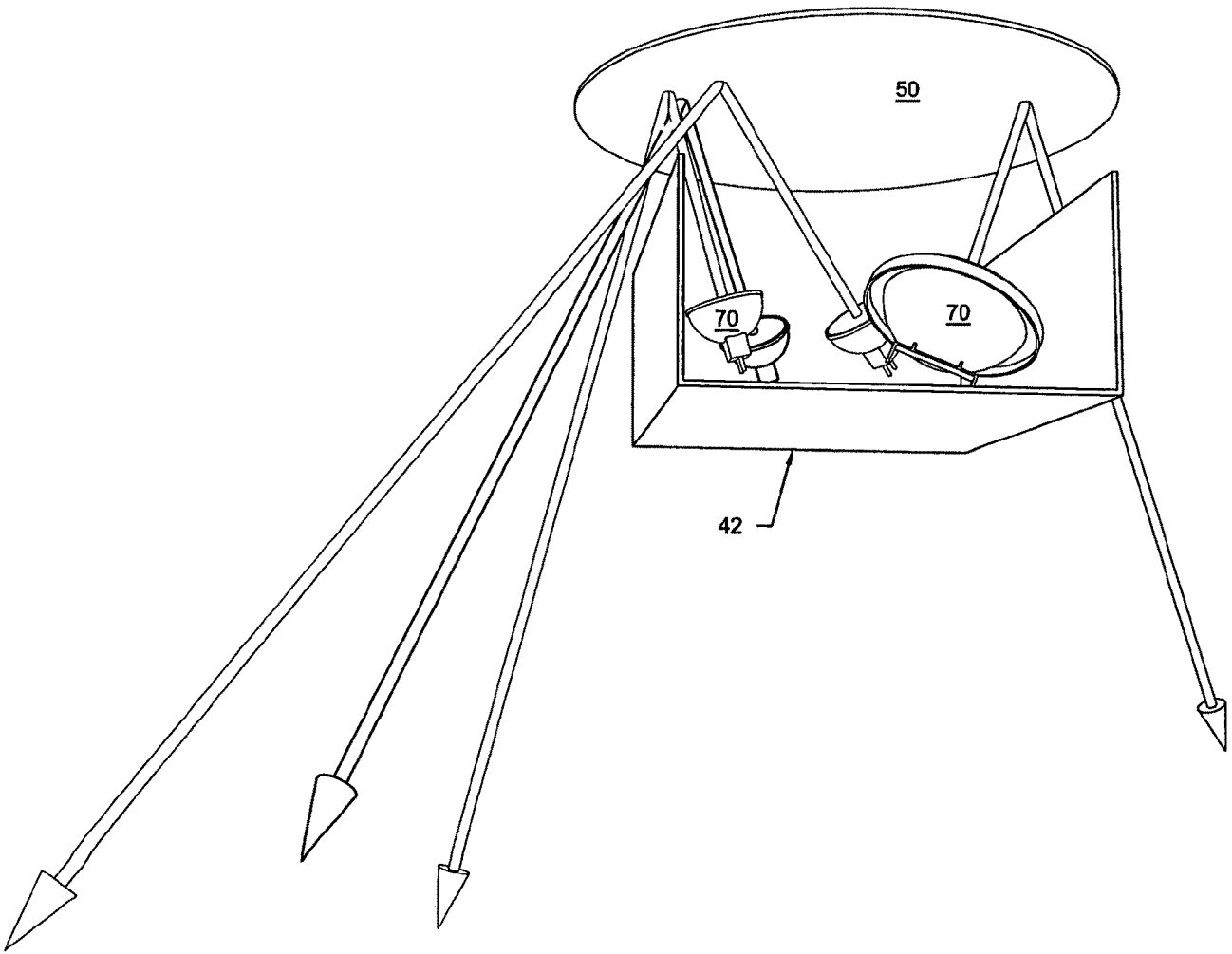
FIG. 32 is a perspective view of an identix.
Figure 33:
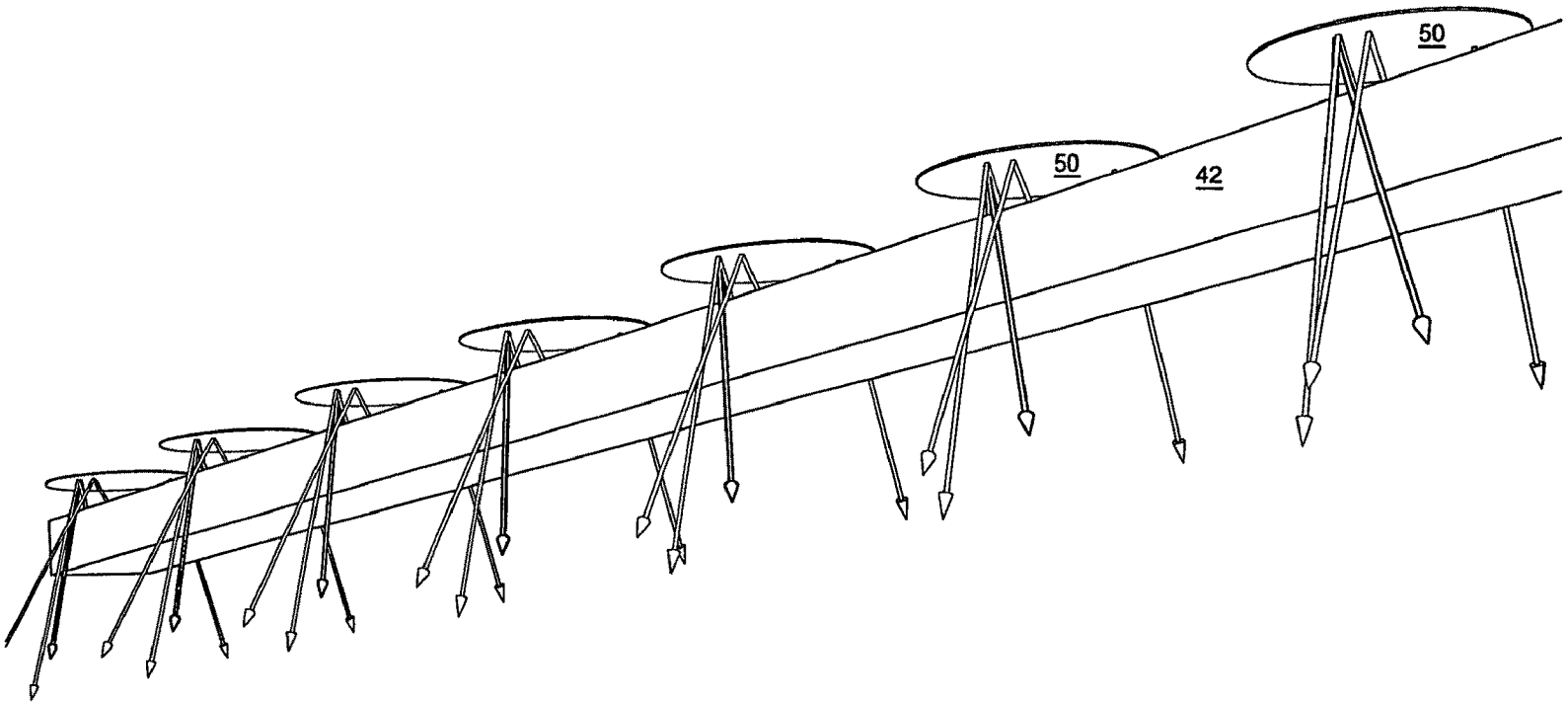
FIG. 33 is a perspective view of another embodiment of an identix with a plurality of reflectors.
Figure 34:
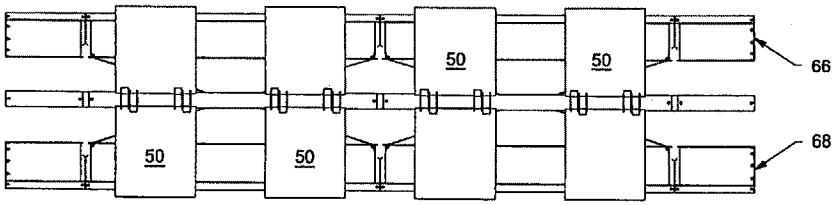
FIG. 34 is a top view of another embodiment of an identix.
Figure 35:
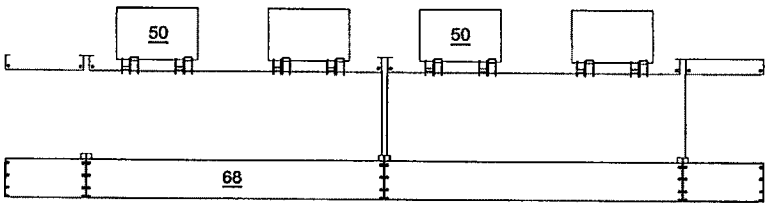
FIG. 35 is a side view of an identix.
Figure 36:
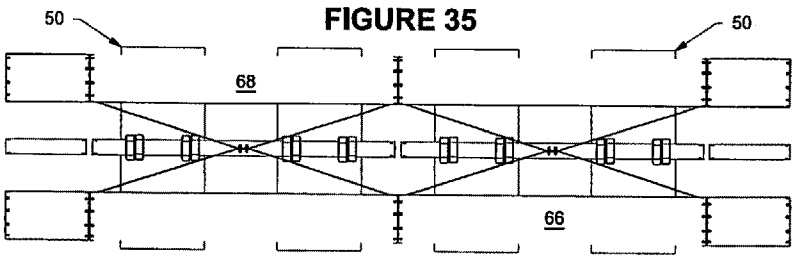
FIG. 36 is a bottom view of an identix.
Figure 38:
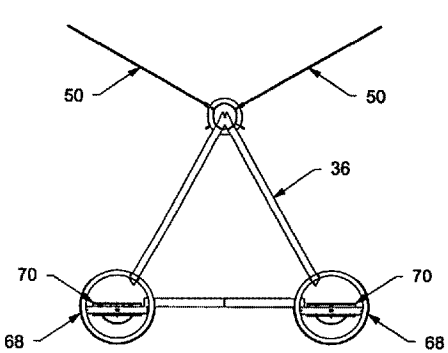
FIG. 38 is a cross-sectional view of an identix.
Figure 37:
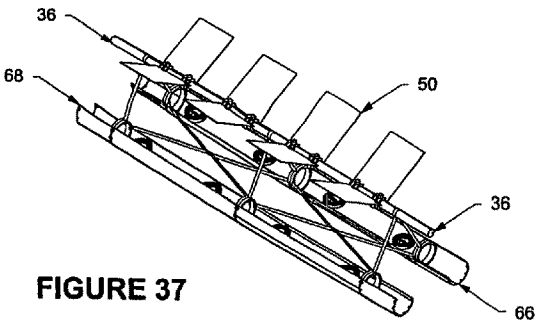
FIG. 37 is a perspective view of an identix.

Referring now to the drawings wherein like reference numerals refer to similar or identical parts throughout the several views, and more specifically to FIGS. 1-5 thereof, there is shown a lighting apparatus 10. The apparatus 10 comprises a light source 12 which produces a light. The apparatus 10 comprises a housing 36 in which the light source 12 is disposed. The housing 36 having a front face 72 through which the light emanates from the housing 36. The housing 36 having a first side 74 and an interior 76. The apparatus 10 comprises a first shutter 78 rotatably connected to the housing 36 which can be set at a closed position that prevents light from emanating from the front face 72, and an open position that does not block any light from emanating from the front face 72, or any angle between the open position and the closed position. The first shutter 78 having an inside face 80 facing toward the interior 76 and an outside face 81 facing away from the interior 76. The outside face 81 having a reflector 50 which reflects the light which strikes it.

Preferably, the apparatus 10 includes a second shutter 82 rotatably connected to the housing 36 which can be set at a closed position that prevents light from emanating from the front face 72, and an open position that does not block any light from emanating from the front face 72, or any angle between the open position and the closed position. The second shutter 82 having an inside face 80 facing toward the interior 76 and an outside face 81 facing away from the interior 76, and the outside face 81 having a reflecting material which reflects the light which strikes it.

The light source 12 preferably includes a plurality of lamps 70. Preferably, the lamps 70 are fluorescent. Alternatively, the apparatus 10 preferably includes gimbal ring 84 assemblies disposed in the housing 36 which holds the lamps 70.

Preferably, the apparatus 10 includes a first motor 86 connected to the first shutter 78 which moves the first shutter 78 into a desired position. The apparatus 10 can preferably include a second motor 88 connected to the second shutter 82 which moves the second shutter 82 into a desired position. Preferably, the apparatus 10 includes a first hinge 90 attached to the first shutter 78 and the housing 36, and a second hinge 92 attached to the second shutter 82 and the housing 36. The apparatus 10 can preferably include a bracket attached to the housing 36 for attaching a housing 36 to a building structure 24.

The present invention pertains to a method for lighting. The method comprises the steps of moving a first shutter 78 disposed in a front face 72 of a housing 36 to a desired position relative to a first side wall 91 of the housing 36 to allow a desired amount of light from a light source 12 disposed in the housing 36 to emanate from the housing 36. The first shutter 78 having an inside face 80 facing toward an interior 76 of the housing 36 and an outside face facing away from the interior 76, and the outside face having a reflecting material which reflects the light which strikes it. There is the step of moving a second shutter 82 disposed in the front face 72 of the housing 36 to a desired position relative to a second side wall 93 of the housing 36 that opposes the first side wall 91 to allow a desired amount of light from the light source 12 disposed in the housing 36 to emanate from the housing 36. The second shutter 82 having an inside face 80 facing toward the interior 76 of the housing 36 and an outside face facing away from the interior 76, and the outside face having a reflecting material which reflects the light which strikes it.

Shutter

In the operation of the invention, the housing 36, such as a typical rectangular housing 36 having a first side 74 and opposing second side, and a third side connected to the first side 74 and second side, and a fourth side opposing the third side and connected to the first side 74 and second side, has a light source disposed in it. The light source 12 can be one or more fluorescent lamps 70, or one or more lamps 70 mounted on gimbal ring 84 assemblies. The housing 36 is mounted to the ceiling 94 or wall 40 of a building structure 24 through brackets.

Along the bottom of the first side 74 of and extending along the length of the first side 74 is a first shutter 78 that is attached to the first side 74 with a first hinge 90. Extending along the second side is a second shutter 82 that is attached to the second side with a second hinge 92. While it is the choice of the user if only one shutter is used, it is preferable to use two shutters that are sized so that when the first shutter 78 and the second shutter 82 are in a closed position, the first shutter 78 and the second shutter 82 define a plane and adjoin with each other to prevent light from emanating from the front face 72 of the housing 36. When it is desired to have light emanate from the front face 72, the first shutter 78 and second shutter 82 are rotated towards the first side 74 and the second side, respectively, to any angular position desired, depending on how much light is desired to emanate from the housing 36. If all the light is desired to emanate from the front face 72, without essentially being blocked at all, then the first shutter 78 and second shutter 82 are put in a position parallel to the first side and the second side, respectively. A reflector 50 on the outside face of shutters enhances the coverage of the light emitted from the lamps 70 in the housing 36. The first hinge 90 and the second hinge 92, of one design, hold the respective shutter at the desired angle as they are moved towards their respective side. Once the respective shutter is moved past parallel with a respective side, then the hinge releases and is free to move back to the perpendicular position relative to the respective side, or otherwise the closed position. Such hinges are able to readily be purchased.

In a preferred embodiment, the first shutter 78 and the second shutter 82 having a first motor 86 and a second motor 88, respectively, which move the first shutter 78 and second shutter 82, respectively, to the desired position relative to the first side 74 and second side, respectively. The motors are mounted alongside the first side 74 and second side and rotate the first hinge 90 and second hinge 92, respectively, to cause the first shutter 78 and second shutter 82, respectively, to be moved into a desired position.

Converters

The present invention pertains to a lighting apparatus 10 for a building structure 24, as shown in FIGS. 6-9. The apparatus 10 comprises a light source 12. The apparatus 10 comprises a holder 14 for the light source 12. The apparatus 10 comprises an attachment 16 connected to the holder 14 to hold the holder 14 to the building structure 24. The apparatus 10 comprises a motor means 18. The apparatus 10 comprises a first screen 20 and a second screen 22 that extend along the light source 12 and are connected to the motor means 18 wherein the motor means 18 moves the first screen 20 and the second screen 22 to desired positions alongside the light source 12.

Converters uses light sources 12 with integrated reflectors 50 and also integrated linear sources (fluorescent and compact-fluorescent). The basic idea is to apply one or more independent screens 26, close to the lamp 70, in a fixture. These screens 26 (that act as reflectors 50) can be changed in position so that the light is changed together with the appearance of the fixture. For example, it is possible to change the light from uplight to downlight, by rotating the screens 26 around the lamps 70. You could also create a wall 40 fixture or a cornice, with a top half that can take two positions: uplight when the top half is flush with the lower half, or indirect forward-light whet the top half is tilted backwards over 30°. Or, it is also possible to make a screen 26 that is composed of two halves, that opens in the middle to add a portion of direct light. This would mean that slideling is a kind of converter. Typical for the converters concept is the fact that the movement is motor-controlled, at least for all fixtures beyond reach, although it does not have to be.

Converter: General Description

The name 'converter' refers to a concept for lighting fixtures with the following characteristics:

- the ability to influence the fixture's lighting effect by a changement in the shape of the fixture
- this changement in shape adds greatly to the aesthetic quality of the fixture, and the fixture looks strikingly different when two positions are being compared.
- the changement in form is the result of the movement of one or more elements 46. This movement can be linear or rotative; it can be done by hand or by one or more motors. The number of different positions ('appearances') can be limited to 2, 3, or 4, so that the difference between the positions remains a dominant characteristic.

Converter: Description of the Fixture

The Converter fixture is a cable-suspended lighting fixture that is designed around a central lamp 70 unit containing two T5 (or others) light sources (and their gears) in a translucent housing 36, so that the light equally comes out in all directions. This unit carries at both ends an identical mechanical element 46 to which two large concave screens 26 are attached. These screens 26 cover the full length of the central unit.

The two mechanical elements, that preferably act simultaneously, each have a remote controlled geared miniature motor 32 in the center that causes a worm-wheel to spin. The spinning movement is transmitted to a symmetrical and simultaneous rotative movement of two gear-wheels, one at each side of the worm-wheel. By a set of levers, this rotative movement is translated to the brackets on which the concave screen 26 is attached.

Both mechanical elements 46 have micro-switches that prompt the movement to stop in a certain position. In case of the prototype, there are two stops.

The first stop or position is when the concave screens 26 close themselves around the central lamp 70 unit at the bottom side of this unit. This way, essentially no direct light from the lamps 70 can reach the floor; all this light is reflected upwards by the concave screens 26 that in case of the prototype have a sheet of specular aluminum at their inside.

The second stop or position is when the screens 26 are rotated above the central lamp 70 unit. This way, an inverse effect is obtained: all the light is being reflected downwards. Only in this position, the two screens 26 are still 5 cm (2 in.) apart, so that a small amount of uplight still reaches the ceiling 94.

Even though there are two stops (automatic positions), it is also possible to create a third position, in which there is an equal amount of uplight and downlight, and practically no side-light. This effect is obtained when the screens 26 are in a position symmetrical to the central lamp 70 unit. This position can be obtained by pressing the 'stop' button on the remote control on a certain moment when the screens 26 are moving from one position to the other. This position is to be done manually for the purpose of demonstration, for instance, at exhibitions.

The moving mechanism is developed in such a way that it can also be used for a linear movement. The Converter range may be extended with fixtures that have sliding doors instead of rotating screens 26. Also, the mechanism is developed in such a way that most parts can be used to make a single-screen version (for instance, a wall-mounted Converter).

The two screens 26 are attached to the rotating brackets in such a way that they can easily be replaced by screens of a different type or finish, for instance, translucent polycarbonate, for different lighting effects.

Fragma

The present invention pertains to a lighting apparatus 10 for a building structure 24, as shown in FIGS. 10-13. The apparatus 10 comprises a light source 12. The apparatus 10 comprises a screen 26 disposed in spaced relation with the light source 12 and adjacent the light source 12. The screen 26 having a first lamella 28 and a second lamella 30, and an opening 34. The apparatus 10 comprises a motor 32 connected to the first lamella 28 and the second lamella 30, wherein the motor 32 moves the first lamella 28 and the second lamella 30 in relation to each other to control light from the light source 12 emitting from the hole by controlling positioning of the first lamella 28 and the second lamella 30 over the opening 34.

SQUARE FRAGMA. 'Fragma' is a motor-controlled reflecting screen 26 to be put in front of a light source 12 that creates the innovative possibility of choosing the amount of light being reflected, and the amount of light still passing through.

This concept is based upon a simplified version of the round diafragma. It appeared that a square diafragma, that uses only two lamellas, is in fact amazingly less complicated than a round one that uses at least six lamellas. Still, the proportion between total surface and total opening 34 remains equal (23%, approximately). The two lamellas are not rotated towards a center-point, but instead, they are moving diagonally towards each other. This simple movement can be accomplished with only one gear-wheel that controls both lamellas at the same time. These lamellas are identical; in fact, we need only five or six different parts that are all used two times. The number of parts is far less than half the number of parts needed for the round diafragma (12 instead of 32 construction parts, and 28 instead of 44 screws). Other advantages are: the opening 34 remains always a perfect square (in the round diafragma, the opening 34 evolved from round to hexagonal), and finally, the total thickness is limited to only 10 mm (17 mm for the round). It is clear you can use it together with 'inflector', as an alternative to a reflector; also a cluster of square fragmas could be used to control the light coming from the ceiling 94 (when openings 34 close, downlight becomes indirect light).

Fragma: General Description

'Fragma' is the name of a concept for reflective screens 26 for use in combination with a beam-type light source 12. This screen 26 (consisting of a single or multiple 'fragma' units) must be placed at a certain distance in front of the lamp 70. It can act as a separate element 46 that needs to be installed separately, or it can be integrated in a lighting fixture that also contains the source. The basic characteristic of 'fragma' screens 26 is that they allow to define how much light is being reflected, and how much is passing through. This is done by a modifiable opening 34 in the center of the 'fragma' unit. A good application is obtained when a fragma unit is installed in such a way that, when fully opened, the main beam (in other words, the brightest center portion of the light cone) of the lamp 70 passes through the opening 34, while the fall-off light (in other words the larger, softer part of the light-cone) hits the non-moving part of the screen 26. By closing the opening 34, a proportionately larger amount of the light will be reflected, and proportionately less light will pass. And by tilting the screen 26, the direction of the reflected light can be controlled without consequence for the passing light.

Modifying the size of the central opening 34 in the screen 26 is done by remote-controlled motor 32. Modifying the direction of the reflected portion of the light can be done by hand or also by motors 32.

Square-Fragma: Technical Description

The changement in size of the central opening 34 is obtained by the simultaneous movement of thin lamellas. In a round version of the fragma, the mechanism will need at least six simultaneously rotating lamellas to get a more or less round opening 34 in all positions. As for 'square-fragma', there are only two lamellas that make a diagonal linear movement instead of a rotation. More importantly, the shape of the opening 34 always remains a perfect square regardless the position. The simultaneous linear movement of both lamellas can be realized with only one motor 32 using one gear-wheel for both toothed racks (one in each lamella). The different position of these racks causes the lamellas to move in opposite directions; yet both lamellas can be identical parts.

A micro-switch activates a 'stop' function on the motor 32 at both extremes of the movement.

This whole mechanism (except for the motor 32) is housed by two finishing plates (one at each side of the mechanism). At least one of these plates is finished with an optically reflective material; so is at least one of the sides of the lamellas. The total thickness will depend on the size, but will mostly be limited to less than 12 mm (½ in).

Readme

The present invention pertains to a lighting apparatus 10, as shown in FIGS. 14-17. The apparatus 10 comprises a housing 36 having a base 38 and a wall 40 extending from the base 38 which defines an enclosure 42. The apparatus 10 comprises a pivotable mount 44 disposed in the enclosure 42. The apparatus 10 comprises a light source 12 disposed in the mount 44. The apparatus 10 comprises a telescoping elongate element 46 which extends from the mount 44. The element 46 having a free end 48. The apparatus 10 comprises a reflector 50 attached to the free end 48 of the element 46, wherein the reflector 50 and the light source 12 disposed on the mount 44 in fixed relation through the element 46 so the light from the light source 12 always reflects from the reflector 50.

Readme consists of a cylindric volume containing three 20 watt MR11 lamps 70 in one large gimbal (that allows tilting over)35° plus a 60 watt transformer, and a reflecting lid that is mounted on a telescopic antenna. The lid can fit on the cylinder to close it when not in use. By moving the lid, a switch activates the lamps 70. Because the antenna is also mounted on the gimbal, the light is always captured by the reflector, no matter what position it is put in. You can also tilt the reflector on the antenna, so the fixture can serve as a desk light when the light is directed back downwards to the desk, or as a decorative light on a cupboard with the light directed to the wall 40 or to an object. But whatever the direction of the light, the three black rings in front of the lamps 70 will keep one from being blinded.

Inflector

The present invention pertains to an apparatus 10 for lighting a room 96 from a wall 40 or ceiling 94 of the room 96, as shown in FIGS. 18-21. The apparatus 10 comprises a light source 12. The apparatus 10 comprises an alcove 52 disposed behind a wall 40 or ceiling 94. The light source 12 disposed within the alcove 52. The alcove 52 having an opening 34 that communicates with the room 96. The apparatus 10 comprises a reflector 50 disposed in the room 96 outside the alcove 52 and positioned to reflect light admitted from the light source 12.

Inflector: Description

'Inflector' fixtures are characterized by the combination of a recessed reflector-lamp, and a separate, mostly surface-mounted reflector or reflecting screen at a short distance to the lamp. This reflector or screen can be orientable, but the lamp is always in a fixed position, projecting its beam to the center of the screen. Being a typical IRS-characteristic, both the lamp and the reflector can be single as well as multiple.

Typical advantages are:

- the possibility to create light and elegant architectural elements that reflect the light of invisibly integrated lamps that might look bulky themselves
- considerable augmentation of the options for light beam treatment, as a result differences in reflecting material (specular, textured, colored, . . . ) and design options (plain reflector, concentric, convex/concave, diafragma-shaped, . . . )

Most applications of the inflector concept will have a wall-recessed light source, and a wall-mounted reflecting screen that reflects the light back upon the wall, or towards the floor, or upwards to the ceiling. By moving the screen (manually or by a motor), various types of lighting can be created.

A different interpretation of the inflector concept is the combination of a wall-recessed light source pointing to the floor, combined with a reflector in a glass-covered housing that is recessed in the floor. This way, 'inflector' creates an alternative to recessed floor fixtures and solves a couple of typical problems for these kind of fixtures:

- power cabling does not need to be provided in the existing floor, which is particularly interesting for redecorating situations
- limited recess depth of the reflector compartment compared to a fixture containing a light source
- the reflector housing can be vacuumized and sealed to prevent condensation, which is a typical problem for all fixtures that need relamping
- the reflector housing does not generate heat; the heat is generated by the lamp which is housed in a separate compartment in the wall where the heat management is much less difficult.

Inflector combines sources that are recessed into the wall 40, with an external element 46 that controls the light coming from these sources. It can be considered a way to provide a uniform and yet flexible way to light a space using only the wall 40, and create a wallwashing effect at the same time. As the actual light source 12 is hidden in a recessed housing 36, its size or appearance will not influence the purity of this wall 40; the only visible elements are a small opening 34 (or a slot), and a reflecting element 46 that creates the downlight. This means also that multiple-sourcing is one of the qualities of this concept: two or more different lamps 70 in the same recessed housing 36, can alternately project their light on the same screen 26 to create shifting atmospheres. Now there is, of course, a great choice of elements 46 reflecting this light. It can be a simple non-movable screen 26; it can be a movable screen 26 that also allows the beam to go upwards (this movement could be motor-controlled). A different interpretation of the inflector concept is to use it upside-down, close to the floor, in combination with a reflector 50 that is recessed into the floor. This way, the typical problems of floor-mounted fixtures can be solved: the advantages are a limited recess depth, no heat coming from the floor, no trouble to replace the lamp 70, a condense-free reflector housing 36, and a possibility to install it in existing floors as we do not need any wiring.

Thorax

The present invention pertains to an apparatus 10 for lighting a building structure 24, as shown in FIGS. 22-26. The apparatus 10 comprises a generator 54 having a plurality of lights arranged in a radial configuration. The apparatus 10 comprises an attachment 16 for holding the generator 54 to the building structure 24. The apparatus 10 comprises a linear reflector 56 in spaced relation to the generator 54 and positioned about the building structure 24 in alignment with the generator 54 to reflect light from the light source 12.

The thorax concept is characterized by two basic elements: a 'generator 54' that combines a large quantity of narrow-beam light sources 12 in a radial configuration; and a linear reflector 56 (or a group of reflectors in a linear configuration) that is remote from the generator 54. The generator 54 is designed to project its beams from a central location towards reflecting surfaces that are mounted at a distance (for instance, to the surrounding walls) around this central point. The idea is to create an innovative way to provide general lighting to a space, with some interesting new possibilities. For instance, the surfaces that reflect the light do not necessarily need to be made of highly brilliant materials; they can be made of satinized aluminum, they can be painted any shade of white, they can be anything that is reflecting enough. Within this line of thinking, the reflectors 50 could have the appearance of a cornice. People will never expect the light to come out of there; besides, a cornice also offers additional uplight possibilities. Yet, of course, the reflectors could also be real individual elements 46, even orientable. The generator 54 would have to contain narrow-beam lamps, such as AR111 4°. If the beams are too wide (using lamps with a beam wider than 8°), an important share of the light will not be captured by the screens 26 (which could be a deliberate choice); unless, of course, if the screens 26 are located close enough to the generator 54, or when a set of lenses are put in front of the lamp (the way it's done in a slide projector). When the beams are carefully controlled, accent lighting with thorax fixtures becomes an option. The fact that all lamps are centralized in a relatively flat housing 36, makes it possible to have this volume recessed into the ceiling 94 when the lamps are not in use. A chandelier could even be mounted at the center of the bottom plate; when the power is switched on, the complete fixture including chandelier is lowered by motors 32 to the desired level. Another possibility is to have two levels of reflectors or a 'double cornice', and programming two levels to which the generator 54 is lowered; this way, an intriguing effect of uplight-becoming-downlight could be realized, or other similar effects when using two different reflecting materials. Although all images show a circular generator 54, it could just as well be square, oval, rectangular, linear or any other desirable shape. It could be the shape of a donut, to fit around a pillar. When the walls 40 are too far from the center of a space to be compatible with this concept, multiple generators 54 could be installed in the same room 96; of course, then there would only be lamps at a certain section instead of the complete circumference of the generator 54. Also possible is a linear generator 54 that is recessed into the wall 40, projecting its beams to the opposite wall 40.

Light-Cell

The present invention pertains to an apparatus 10 for lighting a building structure 24, as shown in FIGS. 27-31. The apparatus 10 comprises a light source 12. The apparatus 10 comprises a translucent tube 58 that is disposed to capture light emitted from the light source 12 at a first end 60 of the tube 58 to create a soft general light effect from the tube 58. The apparatus 10 comprises a reflector disposed in proximity to a second end 64 of the tube 58 to reflect light from the light source 12 that has passed through the tube 58.

Light-Cell: Description

'Light-cell' is the name given to the lighting fixtures with following characteristics:

- single or multiple reflector-lamps, all pointing upwards, are combined with one or multiple reflectors on top at a distance of the light source(s).
- the spill light (the light that couldn't hit the reflectors as a result of the distance between lamps and reflectors), is captured by a structure or a material that spreads this light around, to be used as an additional general light or as a decorative light effect. This can be achieved by a grid-type of structure in metal or another non-translucent material; it can also be achieved using certain glass types or translucent plastics; it can also be a combination of these two. Whatever the variety, this structure must surround the first part of the light beams, i.e. from where the light leaves the lamps. As for the length of this element, the only limitations are that 1. it is long enough to serve its purpose, and 2. short enough to allow the reflectors on top to reflect the light back at the outside of its circumference.
- the lamps are vertically oriented (uplight position); the structure or material around the light beams will therefor be useful as vertical column-shaped light-emitting beacons or reference points in architectural spaces or landscapes; yet the main light beams will be captured by a (possibly orientable) reflector or a set of (possibly orientable) reflectors, reversing the lightbeam's direction back downwards.

In case of landscape use, the reflectors will obviously be a part of the fixture. In case of architectural use, these reflectors can be suspended as a separate element to the ceiling, or they can be a part of the fixture itself. A possible application is to give existing architectural columns a 'light-cell' treatment, by providing a number of sources at the base, surrounding it with a translucent structure or material, and attaching a set of reflectors around the circumference in the top.

Light-cell fixtures do not always have to be column-shaped; linear varieties are equally possible and can serve for architectural partitioning.

Light-cell is a concept in which the light, coming from one or more vertically mounted lamps 70, passes through a satinized glass or polycarbonate tube 58 that captures the falloff light and therefor spreads a soft general light effect; on top, the beams themselves are captured by a reflector or a set of reflectors that is located above the translucent tube 58. An obvious application of the concept is to provide general lighting from the floor in spaces with non-flat or dark ceilings or spaces with a glass roof. This general lighting comes from the luminousness of the glass tube 58 combined with the reflected light from the top reflectors. When these reflectors are brilliant and adjustable, they can also generate an accent lighting. What makes this concept unique is the transparency of the light that is generated by the tube 58; this greatly defines the atmosphere of the space the fixtures are used in. The fixture can actually serve as a kind of 'beacon' in large-scale spaces like airports or shopping malls.

About the top reflectors, these can be suspended at the ceiling 94; they can also be a part of the fixture itself and be mechanically connected to it; the reflector can be a single one or a set of reflectors; they can be flat or convex; brilliant or matte; fixed or adjustable. A pyramidal reflector is shown with adjustable convexity; this movement can easily be realized with a motor 32. The fixture doesn't necessarily need to be circular. It can also be square, rectangular or linear; the translucent tube 58 will then be composed of four glass sheets. In really large spaces, fixtures might take a floor surface over one square meter. A volume like this can be provided with a considerable number of sources; this creates possibilities for multiple circuit lighting with alternating colors, color temperatures and light intensities. Also, fixtures this large can take any available source, even the biggest PAR-lamps. The base 38 of the fixture contains the lamps 70 and their gears; this metal housing 36 rises sufficiently above the lamps 70 so that visual comfort is guaranteed in the proximity of the fixture. The whole of lamps 70 plus gears can be recessed into the floor, so that the translucent part of the fixture starts from floor level. Probably an interesting application is also a mobile 'light-cell', to provide a professional lighting in changeable environments, for instance car showrooms or furniture shops.

Identix

The present invention pertains to a lighting apparatus 10 for a building structure 24, as shown in FIGS. 32-38. The apparatus 10 comprises a first elongate profile 66 having an enclosure 42. The apparatus 10 comprises a second elongate profile having an enclosure 42. The apparatus 10 comprises an attachment 16 connected to the first and second elongate profiles 66, 68 to hold the first and second elongate profiles 66, 68 to the building structure 24. The apparatus 10 comprises a plurality of movable lamps 70 disposed in the enclosure 42 of the first and second elongate profiles 66, 68. The apparatus 10 comprises a plurality of reflectors 50 connected to the attachment 16 and in spaced relationship with the lamps 70, wherein the light emitted from the lamps 70 is reflected by the reflectors 50.

A part of all lighting problems can only be solved by horizontally suspended systems, mostly constructed of an extruded aluminum profile that serves as a housing 36 for the light sources 12. On the other hand, systems like this are often deliberately chosen for their aspect or for their ability to create an architectural element 46 that, for example, helps dividing large spaces into human-scale compartments. An innovative interpretation of the classic 'suspended linear lighting system'—concept can be realized with identix.

A typical phenomenon for all regular systems is that they have a non-uniform appearance when they are used for direct lighting. The identix concept wants to offer an alternative to this, by integrating all lamps 70 invisibly in a profile (single or double), and projecting their beams downwards with identical reflectors that are all identically oriented, above the lamps 70. Aiming the beams will be realized by moving and rotating the lamps 70 in the profile, making sure that the beams always hit a reflecting screen 26. This idea can be translated in various designs. The simplest version will use only a single profile with enough room to shift the lamps 70, combined with horizontal reflectors. The design will be pure and non-technical, and characterized by a rhythmic uniformity although the direct light the system provides is surprisingly flexible.

A different approach characterizes the fixture 'identix twin'. When doubling the number of lamp-profiles, the structure can now also be used for vertical down-lighting (which was impossible in the single version). The lamps 70 are housed in semi-tubular profiles and project their beams upwards to double reflectors, which again increases the aiming possibilities. The design of this system will be 'hi-tech', which stresses its technical innovation. Still another possibility is to make a wall-mounted horizontal structure for accent-lighting. The uniform appearance that characterizes the concept makes it suitable for cornice-like applications that go all over the walls of a certain space.

Identix: Description

'Identix' is a group name for lighting systems with the following characteristics:

- repeated beam-type light sources 12 (reflector-lamps) that are invisibly integrated in a single or multiple linear housing 36
- repeated identical reflectors at a fixed distance from this linear element 46, reflecting the light to where it is needed
- light beam direction is controlled by moving the source or reflector (by moving we mean rotating and in some cases displacing); the intension of these movements is to offer the possibility to make the core of the light beam hit one of the reflectors.

These technical characteristics lead to at least three typical qualities in the application of 'identix' fixtures:

1. the reflectors do not need to be moved to direct a light beam to a certain point or area. All reflectors can be in identical positions, although they reflect the light from the sources in various directions. This adds a typical rhythm to the fixture's aesthetic properties, and creates a surprisingly homogenous look even with different source types and sizes.
2. the reflectors can be used to take the control over the light characteristics to a higher level. Specular reflectors will create sharp-edged light beams, while reflectors with textured surfaces can be used to smoothen the light or equalize differences in beam types or source types. Also, by determining the reflector's angle or by limiting their size or quantity, blinding and dazzling from certain critical viewpoints can be avoided.
3. not all the light is being used for functional purposes (i.e. reflected by the reflectors); a certain part is used first of all to decoratively accentuate the fixture's structure itself and stressing its technical appearance, but also and none less importantly to light the building's structure and textures. The non-functional spill-light which is typical for most reflector-lamps can serve this purpose perfectly.

Identix-Twin:

This horizontally suspended fixture consists of two semi-circular tubes 58 (half-pipes), each containing a number of light source 12 units. These units consist of a gimbal-mounted AR111 lamp and a transformer, mounted together on a bracket that can be slide back and forth in the tube 58 (the way a train would move on its track), for as far as its current wire allows it to go. The combination of the gimbal and the sliding movement allows the light beam to hit a certain reflector within a very wide range. The two half-pipes are separated from and connected to each other by a three-dimensional structure with a triangular cross-section, that carries an array of reflectors on top. The reflectors can be added or removed at will; in the most extreme situation, there are no reflectors at all, and all the light goes up to the ceiling or to reflectors that are separate from the fixture. In the presented prototype, there are two rows of reflectors, each row placed at a different angle. The clamps that hold the reflectors to the structure allow a certain range for the reflector's angle. The fact that there are two non-coplanar rows of reflectors virtually doubles the range of each light beam. For instance, although the gimbal mechanism allows a transversal angle of no more than 40°, light can leave the fixture at angles from vertical to almost horizontal, depending on which row of reflectors is aimed at. The fixture is built as a modular structure consisting of preferably identical one-meter portions. This way, it is possible to construct elements from 1 m up to infinite lengths. In 'identix-twin' however (and probably in most other interpretations of the identix-concept), this unbalanced situation will be dominated by the rhythm and the repetitive appearance of the whole.

Interceptor

Interceptor: Explanation

'Interceptor' is the name of a reflector concept. In its essential form, it does not involve an integrated light source, but uses a part of the light from a remote source. Interceptor creates a new architectural vision on lighting elements.

Interceptor-elements are characterized by following points:

1. it is a single reflector or a group of reflectors, that is installed in such location that it partially captures a passing light-beam from an existing light source. It is important to realize that not the complete light-beam needs to be intercepted: the goal is to use only a portion of this light to create an accent at a different spot.

2. interceptor tries to offer a maximum flexibility at different levels:

flexibility in the direction of the reflected light. To obtain this flexibility, a gimbal mechanism might be used; also any other way to point the reflected light at a desired direction, is part of the possibilities.

installation flexibility. As the existing light beams not always pass along walls, ceilings or other potential mounting surfaces, interceptor offers various ways to get the reflector at the location where it is needed. As a result, the interceptor reflectors can be attached to a set of suspension cables, to an extendable arm, to pantograph-like elements, to tripods, but just as well to a minimalistic bracket or foot; whatever is needed in the given circumstances. For non-permanent wall and ceiling installation, there are possibilities in the use of magnets and suction cups; for non-permanent floor installation, a stable supporting element is sufficient. For permanent installations, the supporting elements will be screwed or fixed solidly in a different way; in some cases, it will even be possible to recess the reflector elements into walls, floors or ceilings.

light characteristics flexibility. There are no limitations in the characteristics of the reflector elements applied in the interceptor concept. Any type of reflecting material has its own valuable particular effects on the reflected light. Also, more complex shapes can be used as reflectors, such as concave shapes, concentric elements, multiple reflectors in a frame, or any other shape that is capable of creating a particular visible effect.

Remark: in some varieties, the reflecting element might be fixed to a particular light source element, therefore creating an 'integrated fixture'. The important distinction to make, is that the reflector does not necessarily have to reflect all or even most of the light coming from the source it is fixed upon, but only bends a segment of the light beam into another direction, while the rest of the original beam still can serve its purpose.

Figure 39:
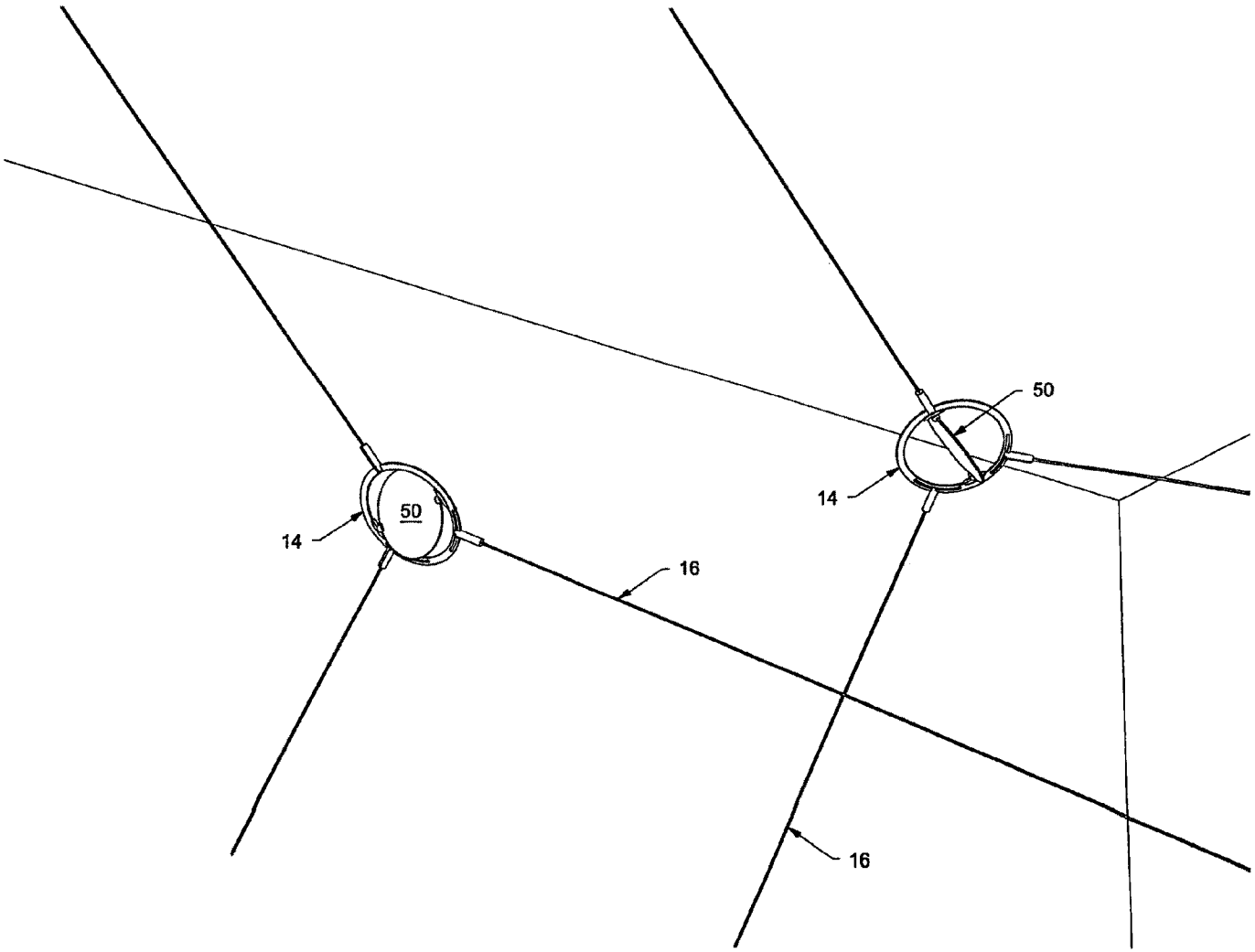
FIG. 39 is a perspective view of a plurality of interceptors.
Figure 40:
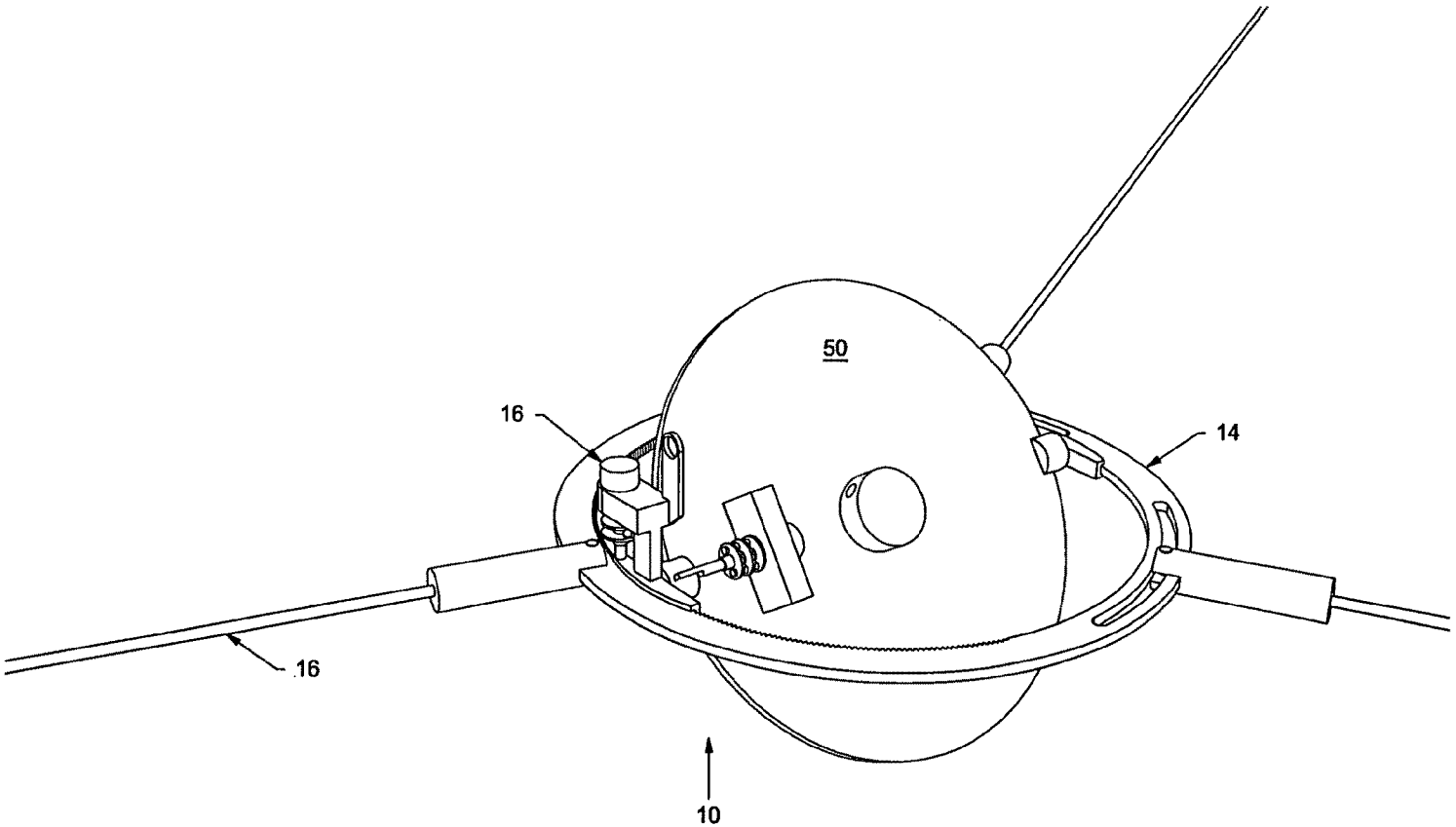
FIG. 40 is a perspective view of a motorized interceptor.
Figure 41:
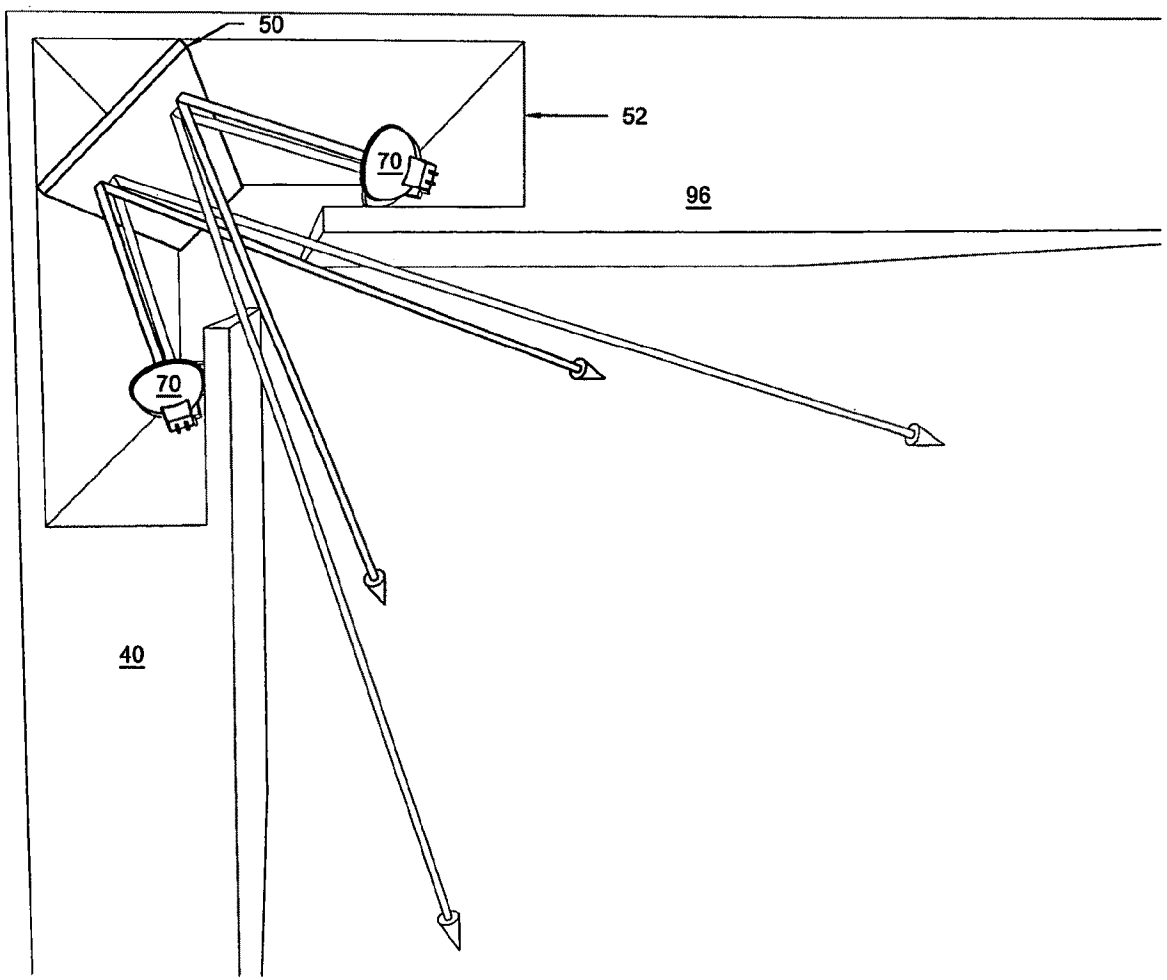
FIG. 41 is a cutaway view of a prismo.
Figure 42:
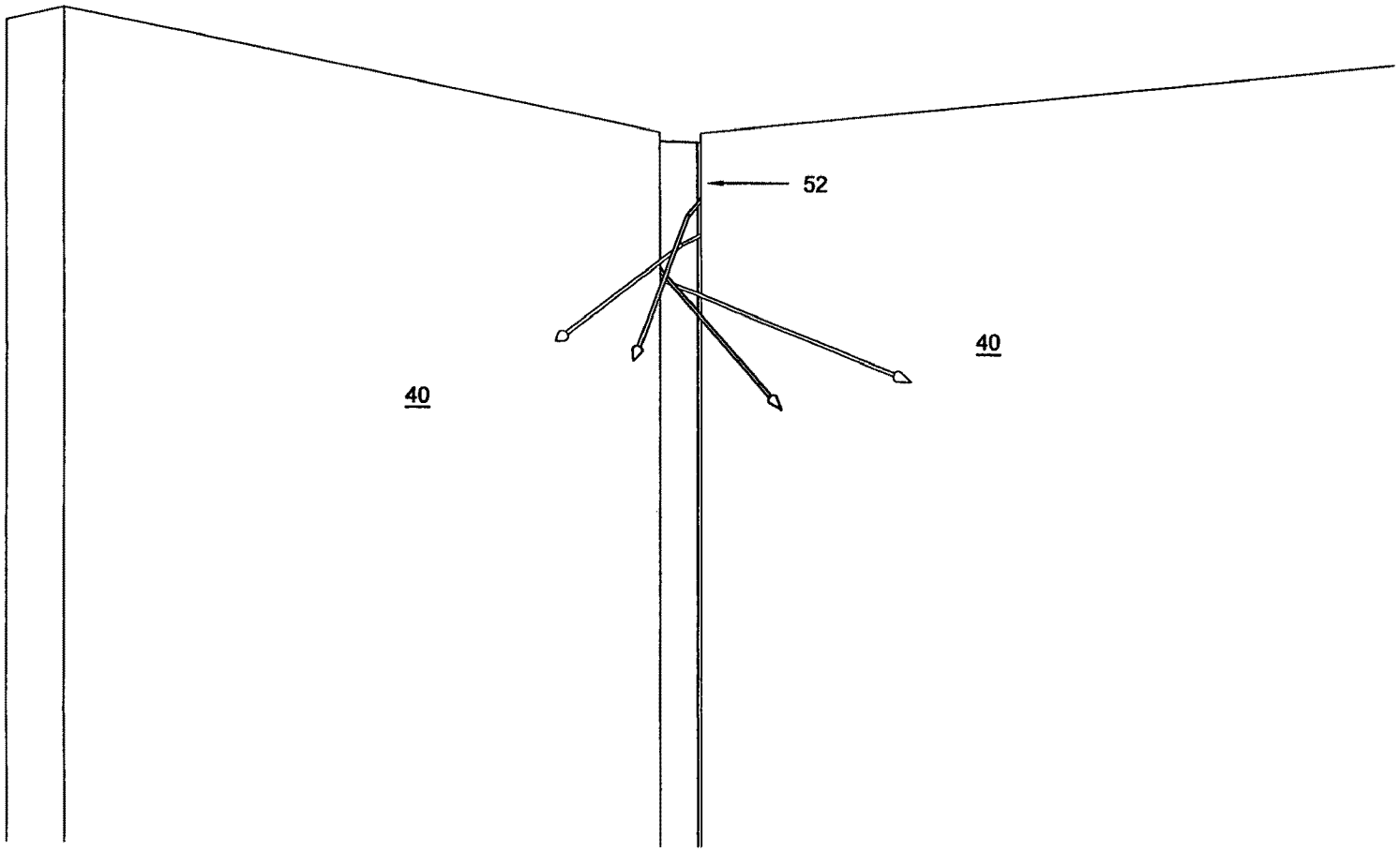
FIG. 42 is a perspective view of a prismo running along the length of a corner of a room.
Figure 43:
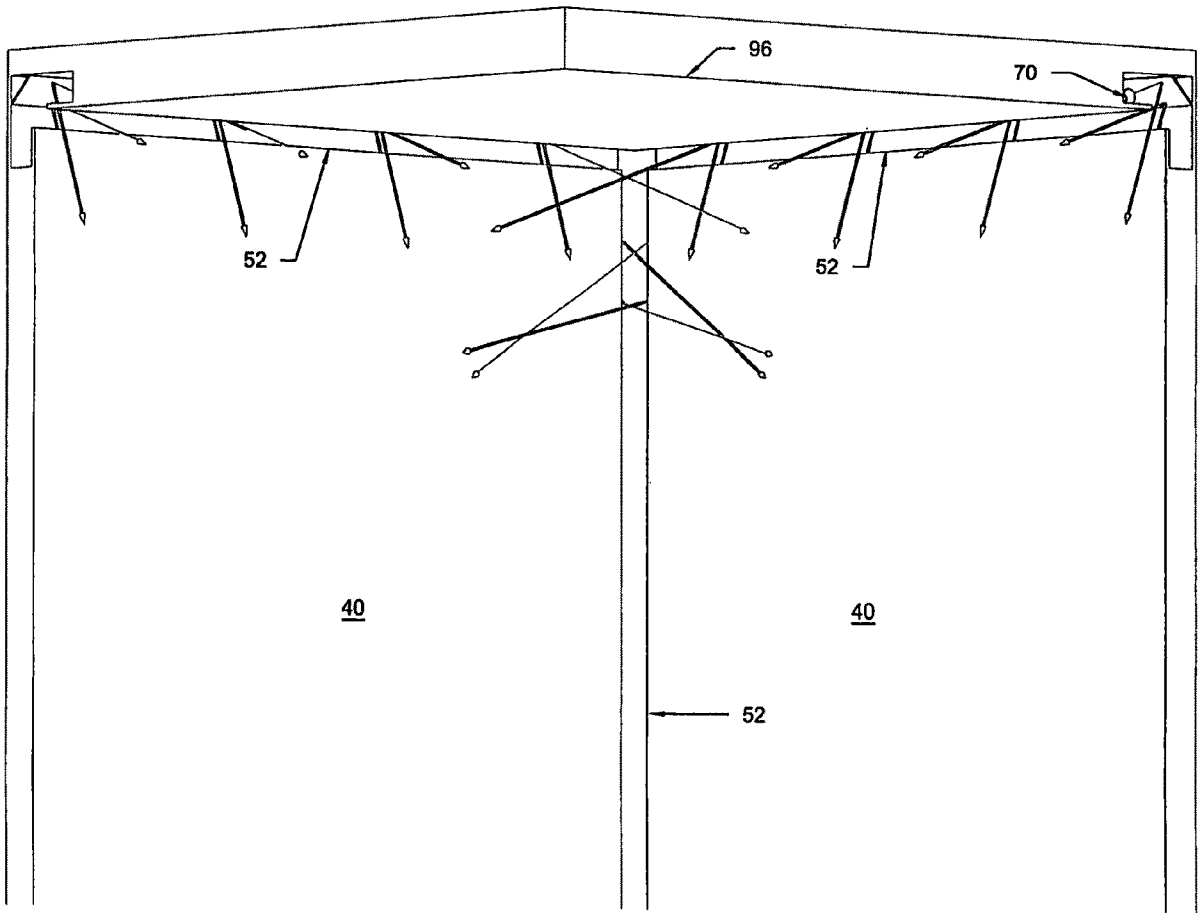
FIG. 43 is a perspective view of a prismo running along the corners of the walls and ceilings of a room.
Figure 44:
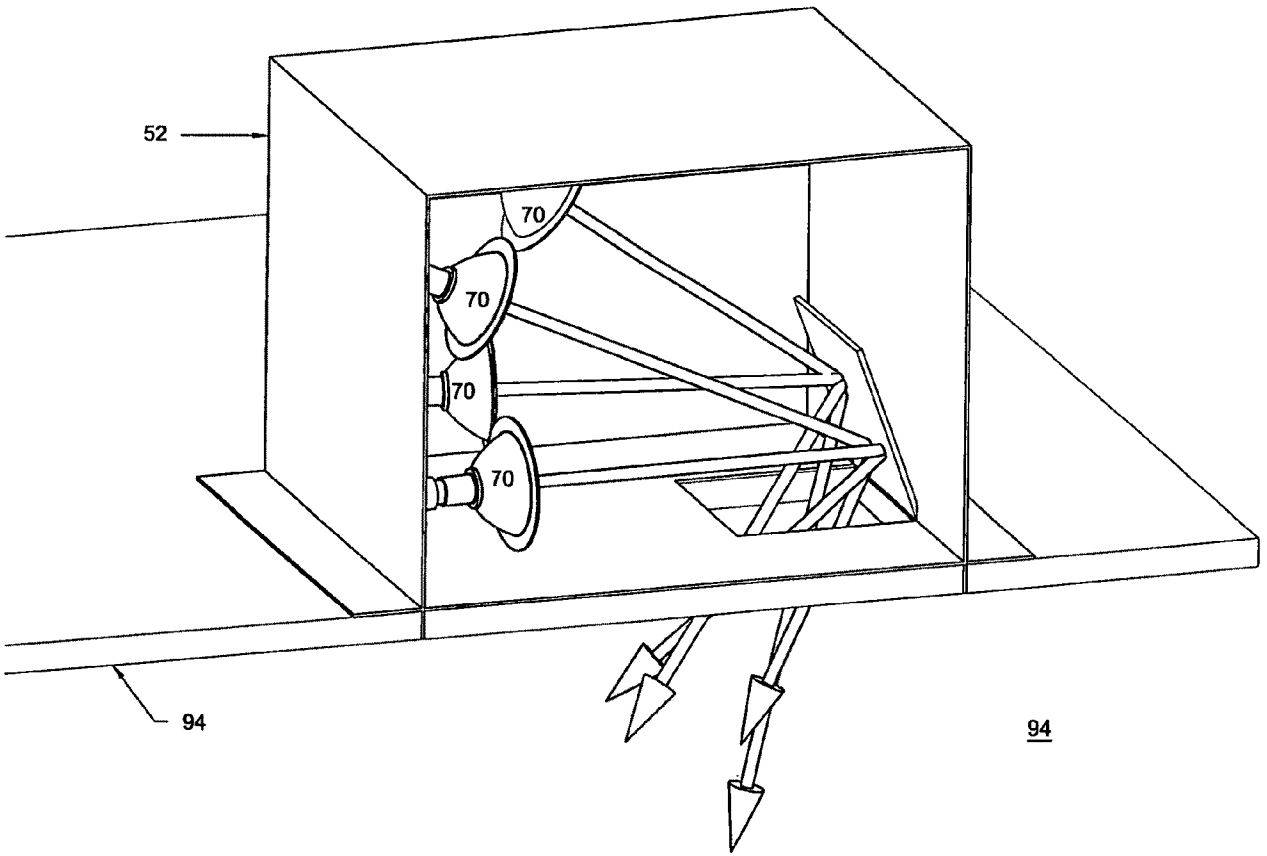
FIG. 44 is a cutaway view of another embodiment of a prismo.
Figure 45:
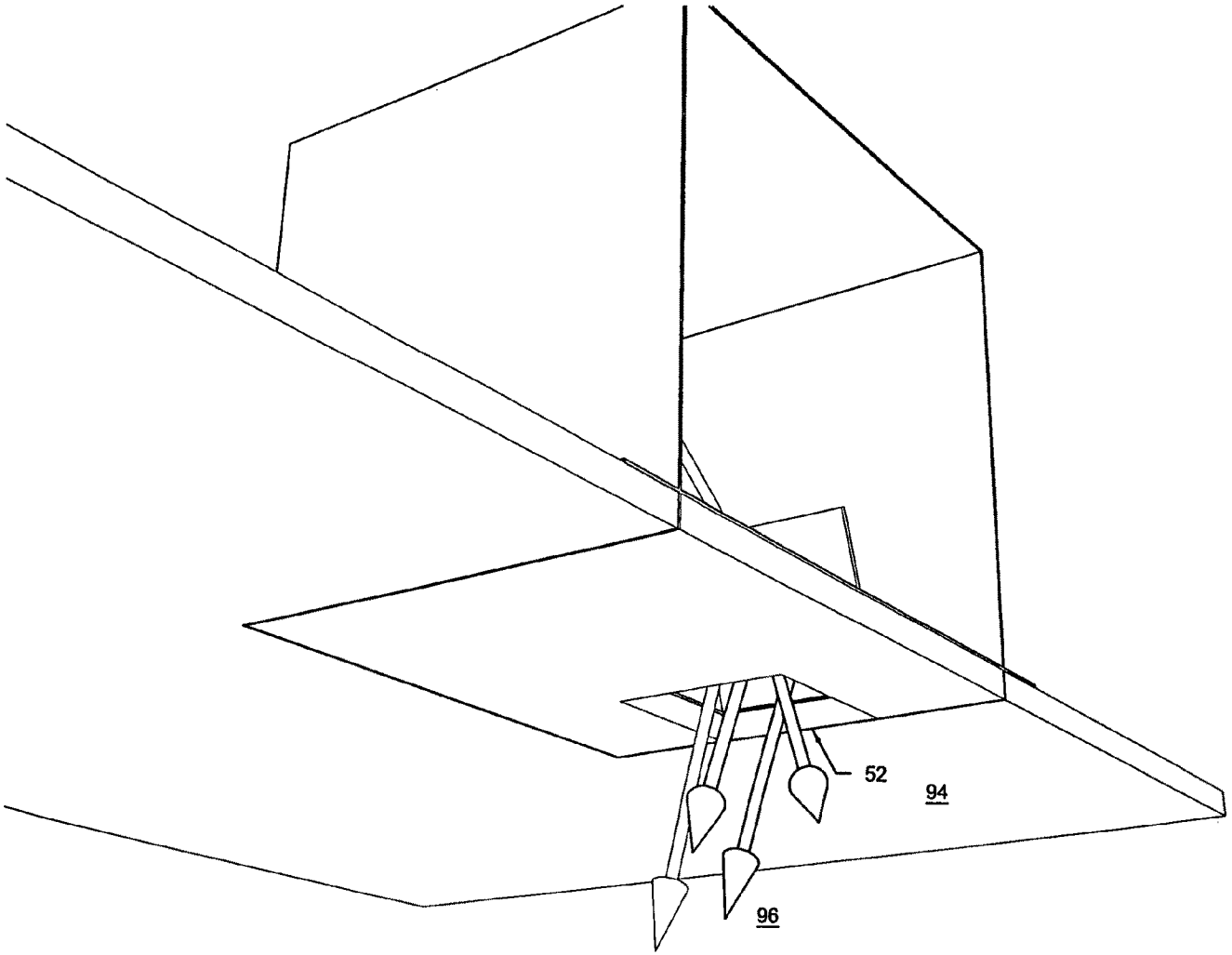
FIG. 45 is a cutaway view of a prismo.
Figure 46:
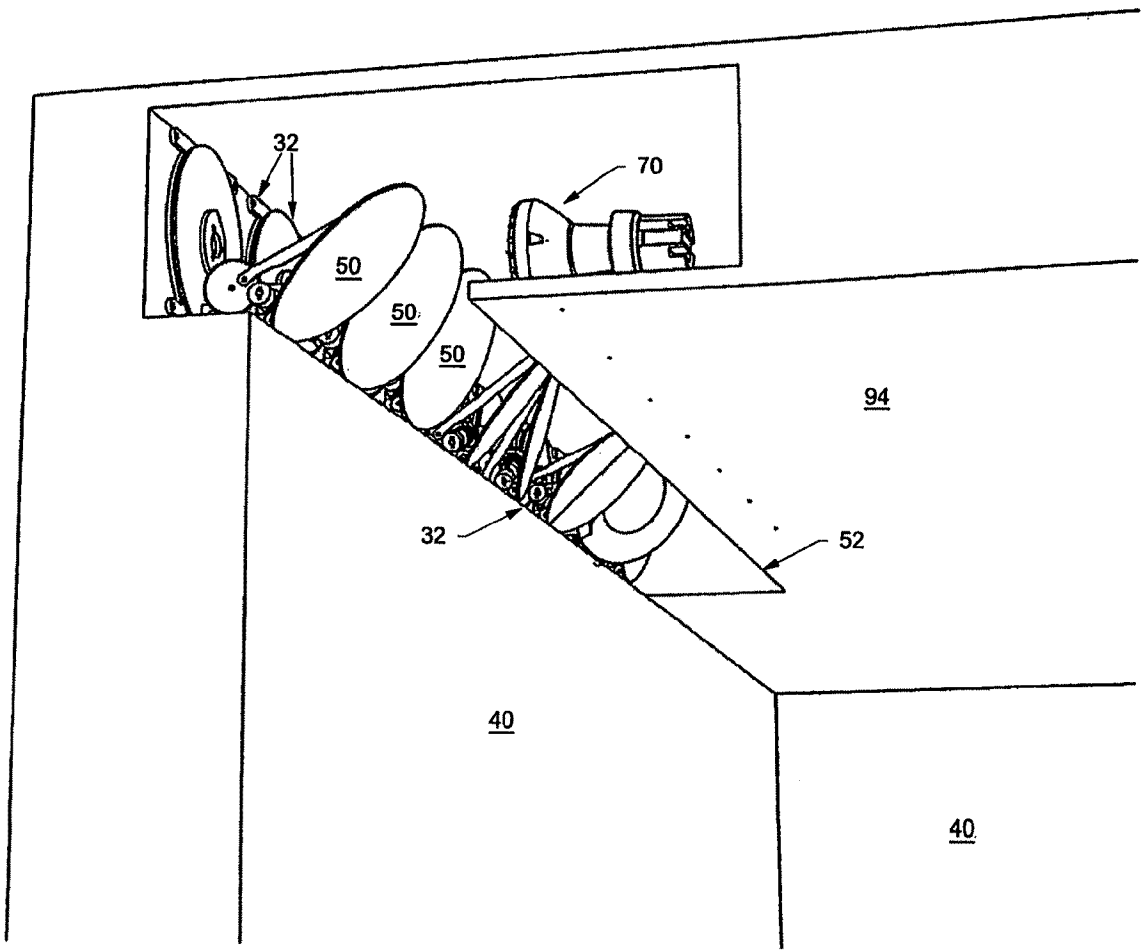
FIG. 46 is a cutaway view of a prismo disposed along the corner of a ceiling and wall of a room.
Figure 47:
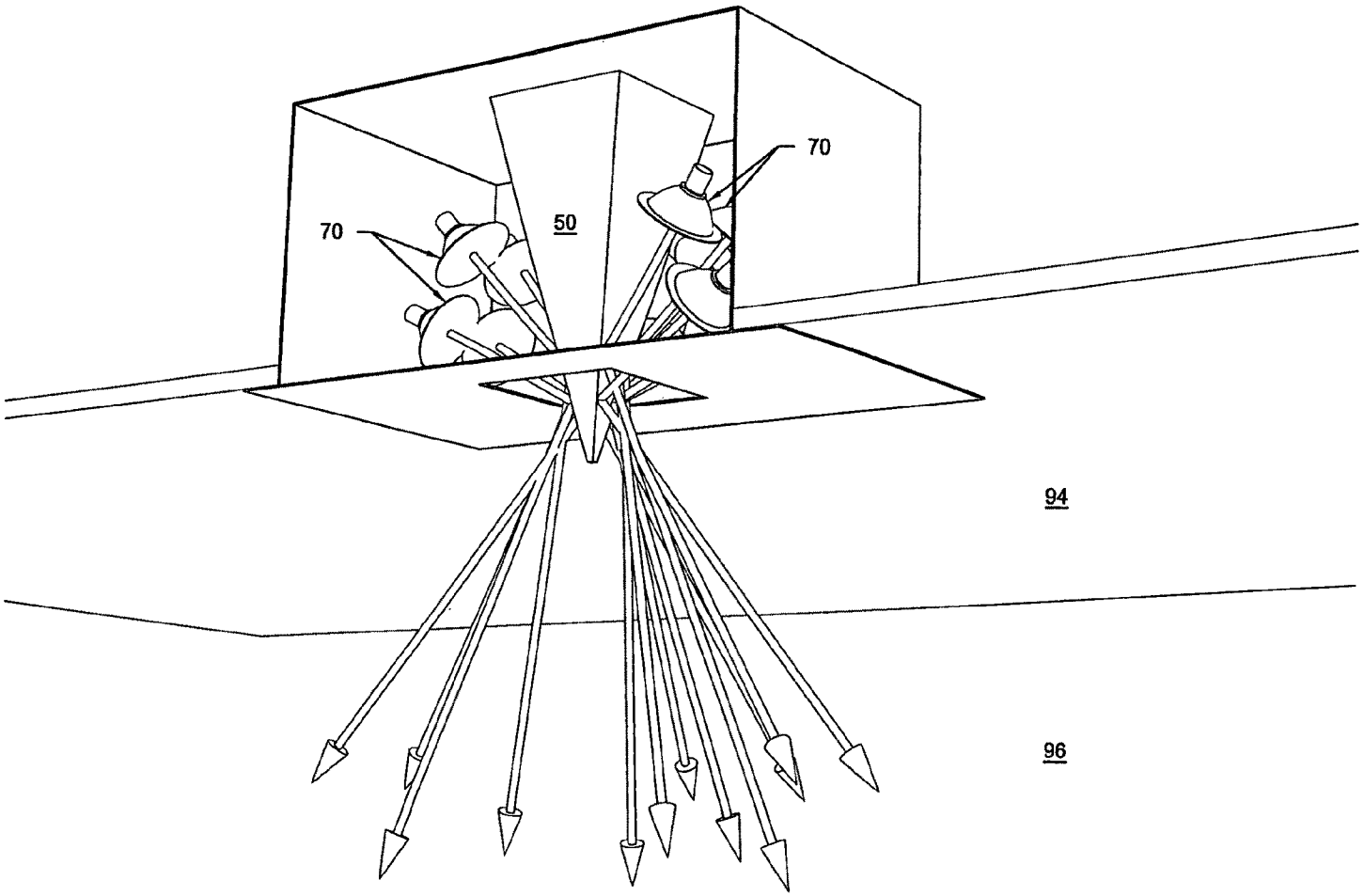
FIG. 47 is a cutaway view of a prismo with a pyramid reflector.
Figures 48, 49, 50:
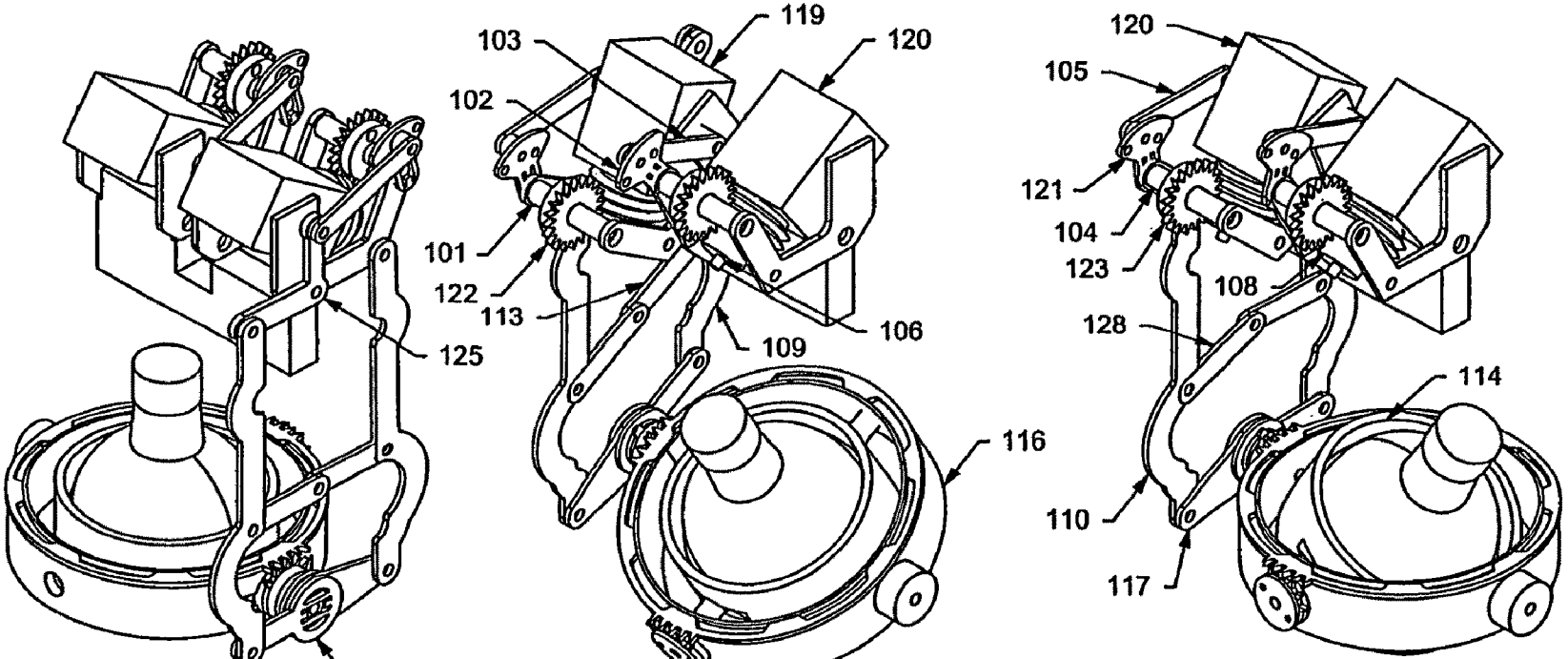
FIGS. 48, 49 and 50 are perspective views of a motorized lamp with the lamp moved into three different positions by the motor.
Figure 51:
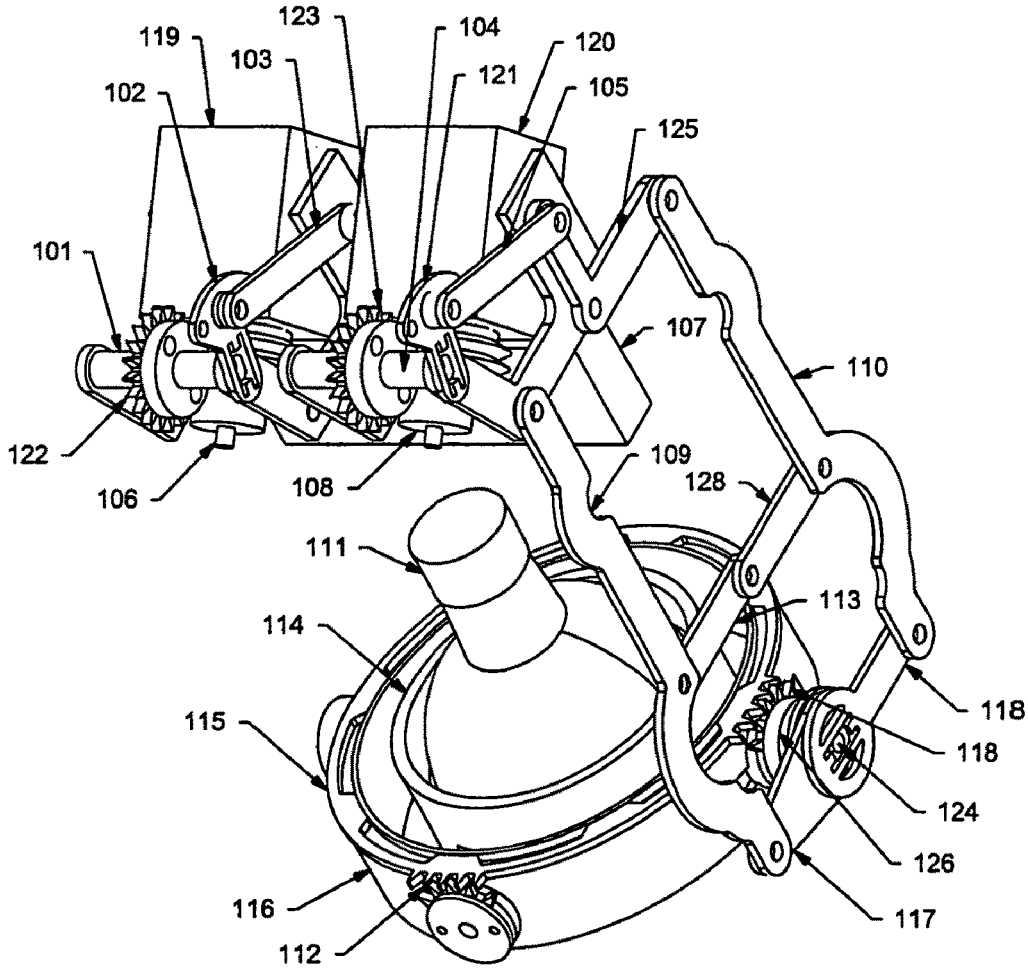
FIG. 51 is a perspective view of a motorized lamp.
Figure 52:
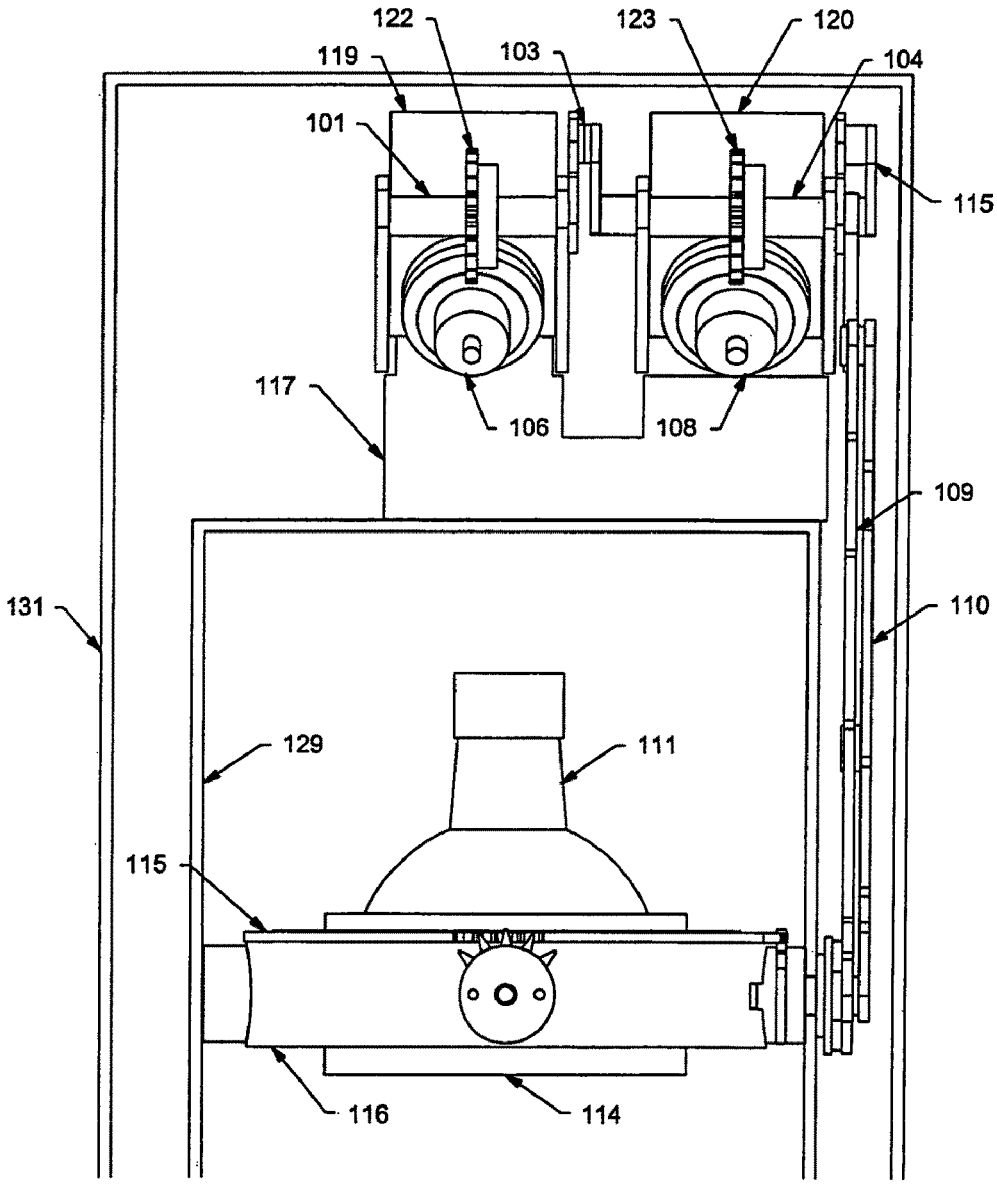
FIG. 52 is a side view of a motorized lamp.

A suspended reflector catches a fraction of a certain light beam, or any light beam, actually. See FIGS. 39 and 40. The construction is designed in such manner that there is maximum liberty in the ways to suspend this reflector, and a maximum aiming range of the reflected beam fraction. In most images, the reflectors are suspended on three tight steel cables for a good stability, but you can think of an infinite number of ways to fix this kind of reflector. You could also combine them and make a cluster, or even make motorized reflectors. What is interesting is that we want to capture only a part of the beam, so we do not need to worry about the light that does not hit the reflector. This means interceptors can be used anywhere, with any beam-type source. The design also attracts because of its discrete super-flat proportions in combination with enough technical elements to convince as a genuine lighting feature.

Prismo

The present invention pertains to an apparatus 10 for lighting a room 96 from a wall 40 or ceiling 94 of the room 96, as shown in FIGS. 41-47. The apparatus 10 comprises a light source 12 which emits light. The apparatus 10 comprises an alcove 52 disposed behind the wall 40 or ceiling 94. The light source 12 disposed within the alcove 52. The alcove 52 having an opening 34 that communicates with the room 96. The apparatus 10 comprises reflectors 50 disposed in the alcove 52 and positioned adjacent the light source 12 to reflect the light from the light source 12 through the opening 34 into the room 96.

Preferably, the light source 12 includes a plurality of lamps 70 producing the light disposed in the alcove 52 and at desired locations with respect to the reflector 50. The alcove 52 preferably extends along a corner of the room 96 defined by where the ceiling 94 and the wall 40 intersect.

The present invention pertains to a method for lighting a room 96 from a wall 40 or ceiling 94 of the room 96 the method comprises the steps of placing a light source 12 in an alcove 52 disposed behind a wall 40 or ceiling 94. There is the step of aiming the light source 12 so light emitted from the light source 12 reflects off of a reflector 50 disposed in the alcove 52 and through an opening 34 of the alcove 52 into the room 96.

In the operation of the invention, lamps 70 are positioned in the alcove 52 of a wall 40 or ceiling 94 of a room 96. The lamps 70 can be fixed in place or rotatable. The lamps 70 are positioned so that light emitted from the lamps 70 reflects off of one or more reflectors 50 inside the alcove 52 and through an opening 34 in the alcove 52 into the room 96. It is preferred that there are no lamps 70 that emit light directly into the room 96, but only from the reflector 50 positioned in the alcove 52. The alcove 52 can be positioned in the wall 40, or the ceiling 94, or along the intersection of the wall 40 and the ceiling 94, or along the intersection between walls 40 of the room 96, or any combination of these embodiments. In this way, no direct light needs to shine in the room 96, but only light that has been reflected into the room 96.

Prismo: Description

The name 'prismo' defines all lighting fixtures with the following characteristics:

one or more beam-type light sources (reflector lamps) and one or more reflectors are combined within a common recessed housing. Both the reflectors and the lamps are invisibly integrated. The reflectors are positioned in such way that they reflect the main beam coming from the lamps through one or more openings in the recessed housing.

directing the light beam can be done as well as by moving the lamp, by moving the reflector, or by a combination of movements of both the lamp and the reflector.

The particular advantages of 'prismo' are:

visual uniformity. The appearance of the fixture is always homogenous, also when different source lamp types & sizes are mixed.

multiple sourcing. It is possible to combine a single reflector with multiple lamps of different types. This way, multiple circuits (e.g. day and night) can be applied in what seems to be a single-circuit fixture.

In 'prismo', there are three different sub-groups to be defined so far.

1. 'prismo-1D' ('D' is for dimension): linear fixtures. Multiple orientable reflectors are arrayed in a row and reflect the light from the equally arrayed lamps through a linear opening.

Variety: instead of multiple orientable reflectors, the fixture can also have only one single linear reflector. Of course, this limits the orientability of the light beams.

Advantages: a uniform appearance (only a linear reflector or a set of identical reflectors are visible), and a limited recess depth, as the lamp is placed perpendicular to the opening.

2. 'prismo-2D': compact fixtures. A single, possibly orientable reflector reflects the light of multiple lamps. These lamps are orientable, but in such a way that they always point to the reflector's center. Advantage: only small openings are required.

3. 'prismo-3D': voluminous fixtures. A polar array of possibly orientable reflectors above a central opening, reflecting the light of multiple sources that are positioned around the set of reflectors. These lamps are orientable and always point at a reflector's center.

Prismo 1D

"Prismo" is the name of a concept that can be translated into three groups of applications; we will call them Prismo-1D, Prismo-2D and Prismo-3D. All types of prismo are characterized by the same basic elements: a large box-shaped housing 36 containing one or more lamps 70, and a reflector that is always inside this same housing 36 reflecting the light of all bulbs. The light beam direction is controlled by choosing a certain position of the lamp 70, rather than changing the position of the reflector. As a result, the light comes out of relatively small, minimalistically shaped openings 34 that always look the same, even when they emit the light of a large quantity of lamps.

Prismo-1D is an interpretation of the concept that puts all the lamps at one level, only allowing them to be tilted in one plane. The light is reflected by a linear reflector 56, and comes out of a linear opening 34. (When the quantity of lamps is limited, the reflector 50 and the opening 34 might also be square.) Because all bulbs are at the same level, the recess depth will be limited. This version is interesting for recessing into walls 40. The reflective images of the lamps in the reflector; under the rare circumstances that you actually see the lamps, they seem so far away that this effect will be dominated by the presence of the reflector, so the fixture will keep its minimalistic aspect.

When the lamps 70 are tilted over a certain angle, the angle of the beam is doubled by the reflector. This means that the maximum range will be considerable, especially as the fixture is linear.

There is an additional possibility: the reflector could also be tiltable (over small angles). Tilting the reflector will then result in all the beams being moved simultaneously in the space. This movement could be motorized.

Prismo 2D

Prismo-2D (the 'd' stands for dimensions, so you can expect prismo-2D to be more flexible and versatile than prismo-1D) has a higher housing 36, allowing the bulbs to be moved in all directions—as long as their beams are aimed towards the reflector. Each lamp 70 is mounted on a separate yoke that allows the lamps 70 to be set anywhere you want within the housing 36. The figures illustrate the flexibility of the aiming range, while the aspect of the fixture remains unchanged. Of course, all prismo fixtures will be able to take more than one kind of light source 12, from halogen to discharge sources; the only condition is that the lamps 70 generate narrow beams. In some cases though, it might be advisable to put an accessory ring in front of the lamps 70 to calibrate the beam. As prismo-1D is a rather linear concept, prismo-2D is rather point-like. If the housing 36 is big enough, the light coming from a large quantity of lamps can pass through a single opening 34 of only 250 by 250 mm. Probably ceilings will offer most application possibilities for prismo-2D; the matter of accessability to the sources must be solved differently for every different type of ceiling. It is easy to imagine a fixture as illustrated in the images in a suspended tile-ceiling; in gypboard ceilings, this element 46 will need a different approach. There are also some additional possibilities. Images 'prismo-2D-b' and 'prismo-2D-c' show how the reflector serves as a lid that covers the opening 34 when the lamps are switched off; this can be done with motors 32. And image 'prismo-2D-d' illustrates the use of a composed reflector (a bit like the one used on Multex-2), to split the beams into independently moveable fragments.

Prismo 3D

Prismo-3D adds even one more dimension to the concept: a number of lamps 70 are now gathered circularly around a pyramid-shaped reflector. All lamps 70 at a certain side of the pyramid are pointed towards the same area on this pyramid. As was the case in previous two prismo-interpretations, the direction of the light beam depends on the position of the lamp 70 in relation to the reflector; so when a lamp 70 is moved to the left, its beam will go to the right; and when it is rotated upwards, its beam becomes more vertical, as shows the arrows on the image.

It does not matter how many lamps there are at each side, nor what type of sources are used. In the example, AR111 bulbs are mixed with CDM-R PAR30 lamps. The lamps should be mounted on yokes that make it possible to easily change their positions in the housing 36 and thus changing the directions of their beams. The next images show how the light of all lamps passes through a square opening 34 in the cover plate of the housing 36; this opening 34 is relatively small. (When pointing the lamps, a particular area on the reflector should be aimed for, to make sure their beams pass nicely through the opening 34.) The pyramid decoratively points through the opening 34 like a diamond. The housing 36 can be interpreted in various ways: it can be considered a recessed housing 36, but it can also be suspended as a voluminous fixture in the space. Its surface can be finished in accordance with the atmosphere of the environment, even with wooden panels or reflectors; or it can also be simply painted. Another idea could be to make a satinized glass cover plate with a square opening 34 at the bottom, to accentuate the fixture using the falloff light that did not hit the reflector. You could even use the pyramid point to suspend another fixture like a crystal chandelier, for instance, for a 'fifties' version of a chandelier. This way, this concept can even blend perfectly into a Louis XIV environment. Of course, there is no need for the lamps to be switched on all at the same time. The volume of the housing 36 permits a large quantity of lamps plus their gears; this allows to integrate multiple circuits in one fixture.

Motorized Gimbal: Explanation (See FIGS. 48-52)

1. All movements are accomplished by using gear wheels and levers to secure a lasting and heat-resistant transmission, which cannot be accomplished when using rubber belts.
2. For the greater part, the mechanical elements (gears, levers and motors) are removed from the lamp 70 compartment. Advantages: transmission is invisible from beneath (so the original gimbal look is almost untouched); also the heat generated by the lamps 70 is removed from the motors 32, which will increase the motor's 32 life.
3. Both gimbal movements (from north to south and from east to west) are 'endless loop' movements. When the motor 32 keeps running, the ring keeps tilting back and forth. This means no microswitches are needed to automatically stop the movement. In the proposition illustrated here, the range is 36° in all directions. In one embodiment, there is a possibility to choose the range: 30°, 35° or 40°. This is done by mounting two of the levers differently. One of these parts has three holes, each representing a certain range. We did this to avoid that the back side of longer lamps would hit the inside of the housing 36 it is moving in.
4. Motorized multiple fixtures have a double housing 36: an inner housing 37 for the lamps 70 and gimbals, and an outer housing 39 covering the mechanical elements 46. (The housings are semi-transparent in the representation). The levers that transmit the movements, are sandwiched by both housings for maximum protection. The outer housing 39 can easily be removed for maintenance or reparation purposes.
5. Both gimbal movement are independent from each other. When the outer ring is tilted, it will not affect the position of the inner ring. To accomplish this, the motor 32 that causes the inner ring to move is moved along with the outer ring in a lever-activated tilting movement, so that its relative position remains the same.
6. Both movements (inner & outer ring) are transmitted at the same side of the housing 36 by using a concentric transmission axle. The inner axle controls the outer ring, the outer axle controls to movements of the inner ring, via a set of gear wheels. As the complete transmission of the gimbal is at one and the same side of the housing 36, the width of this housing 36 (read: the diameter of the gimbal) does not affect the size of the mechanical elements 46 above this housing 36. If in the opposite case one movement were transmitted at one side of the housing 36 and the other movement at the opposite side, this would result in different mechanical elements 46 on top of the housing 36 for each different width of housing 36.

Motorized Gimbal: General Characteristics

1. All movements are accomplished by using gear wheels and levers to secure a lasting and heat-resistant transmission, which is more difficult to accomplish using rubber belts.

2. For the greater part, the mechanical elements (gears, levers and motors) are separate from the lamp compartment. As a result, the transmission is invisible from beneath, so the gimbal looks very similar to any manual gimbal; also the heat generated by the lamp ill is removed from the motors 119, 120, which will increase the motor's life.

3. Both gimbal movements (outer ring and inner ring) are 'endless loop' movements. When the motor keeps running, the ring keeps tilting back and forth. This means no microswitches are needed to automatically stop the movement. The mechanism offers a choice between three different maximum ranges: 30°, 35° or 40°. This choice is made during the final assembly of the mechanism in the fixture and will depend on lamp type and the width of the opening through which the light beam is passing in proportion to the depth to which the gimbal is mounted.

To choose the desired range for the outer ring, the connecting rod 103 is fixed to one of the three available holes of the rotating crank 102, each hole representing a particular range for the outer ring.

To choose the desired range for the inner ring, the connecting rod 105 is fixed to one of the three available holes of the rotating crank 121, each hole representing a particular range for the inner ring.

4. The transmission of the outer ring is as follows: the shaft of the first motor 119 is fixed to a worm wheel 106, that drives a gear wheel 122 that is fixed to an axis 101. This axis drives a rotating crank 102 that is connected to a connecting rod 103. This rod causes the second motor 120 and all its mechanically dependent elements, including the transmission of the inner ring, to tilt back and forth. The vertical lever 109 is moved up and down by this tilting movement; a stabilizing rod 113 forces it to remain vertical. The vertical lever 109 drives the inner axis crank 118, that is fixed on the outer ring axis 124, which is by the way the inner axis of a concentric pair. Finally, this axis 124 moves the outer ring 116 in which it is inserted.

5. The transmission of the inner ring is as follows: the shaft of the second motor 120 is fixed to a worm wheel 108, that drives a gear wheel 123 that is fixed to an axis 104. This axis drives a rotating crank 121 that is connected to a connecting rod 105. This rod causes an L-shaped bracket 125 to tilt back and forth. The vertical lever 110 is moved up and down by this tilting movement; a stabilizing rod 128 forces it to remain vertical. The vertical lever 110 drives the outer axis crank 117, that is fixed to the outer axis 126 of the concentric pair. This axis is fixed to a wheel with a toothed segment 127, that drives a geared ring 115 on top of the outer ring 116. This geared ring drives a second wheel with a toothed segment 112, that is fixed to the inner ring axis.

6. As a result of this design, both gimbal movements are independent from each other. When the outer ring is tilted, it will not affect the position of the inner ring. This is accomplished by the tilting movement of the second motor and its mechanical dependents along with the movement of the outer ring.

7. Motorized multiple fixtures have a double housing: an inner housing 129 for the lamps and gimbals, and an outer housing 130 covering the mechanical elements. These mechanical elements are mounted on one common bracket 107, that is fixed on top of the inner housing. The levers that transmit the movements 109, 110, 113, 128, 117 and 118, are sandwiched by the walls of the inner and the outer housing, so they are protected from dust. As the transmission levers are made of flat material, the distance between the walls of the inner housing and the outer housing is only a few millimeters. This way, the presence of the mechanism does almost not influence the fixture's visible size.

The outer housing can be removed for maintenance or reparation purposes.

8. By using a concentric transmission, both movements (inner and outer ring) are transmitted at the same side of the housing. As a result, the same mechanism can be used for whatever width of housing, and for whatever size of gimbal rings.

For larger diameter lamps, the only elements that need to be modified are the gimbal rings 114, 116, and the geared ring 115.

For lamps with longer rear ends that need an inner housing with more depth, the only parts that need modification are both vertical levers 109, 110, which are by the way identical parts.

Momo

'Momo' is the name that is given to compact wall-mounted fixtures with one or more reflector lamps, and a reflecting screen that can be tilted and that reflects the light from the lamp(s) into a certain desired direction. By moving or adjusting the screen's angle, differences in atmosphere are created. For instance, the screen can reflect the light directly into the room, creating a powerful general lighting; the same screen in a different position can also reflect the light back upon the wall, creating a much softer indirect lighting.

Obviously, the reflecting qualities of this screen will greatly affect the properties of the reflected light, as for the color or color temperature or the softness of the light; so all types of reflecting materials can be used in this concept, with virtually no limitations. The momo concept wants to offer a lot of options to control the light in a relatively simple, compact and elegant fixture.

Figure 53:
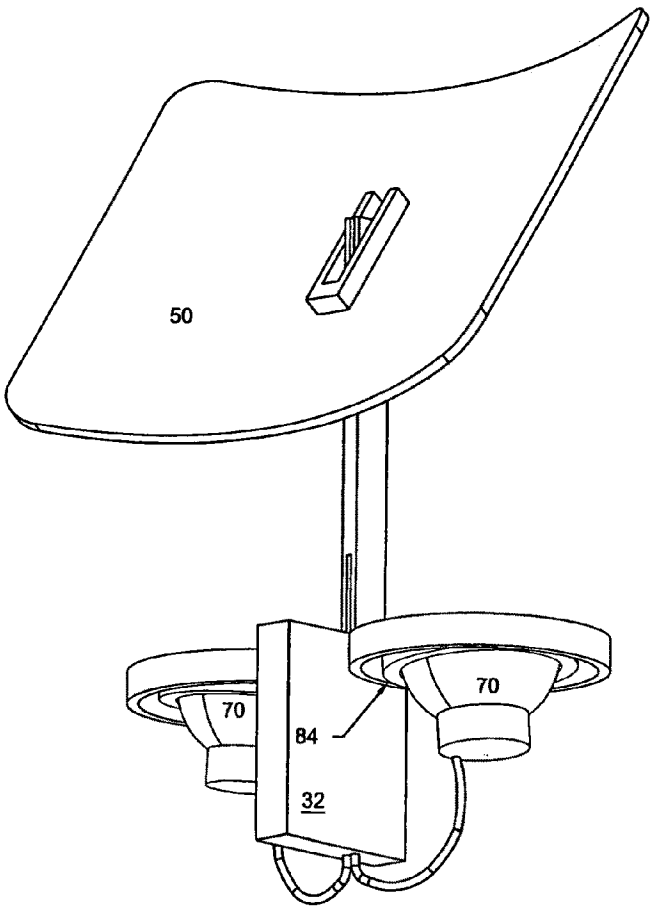
FIG. 53 is a perspective view of a momo with the reflector in a first position.
Figure 54:
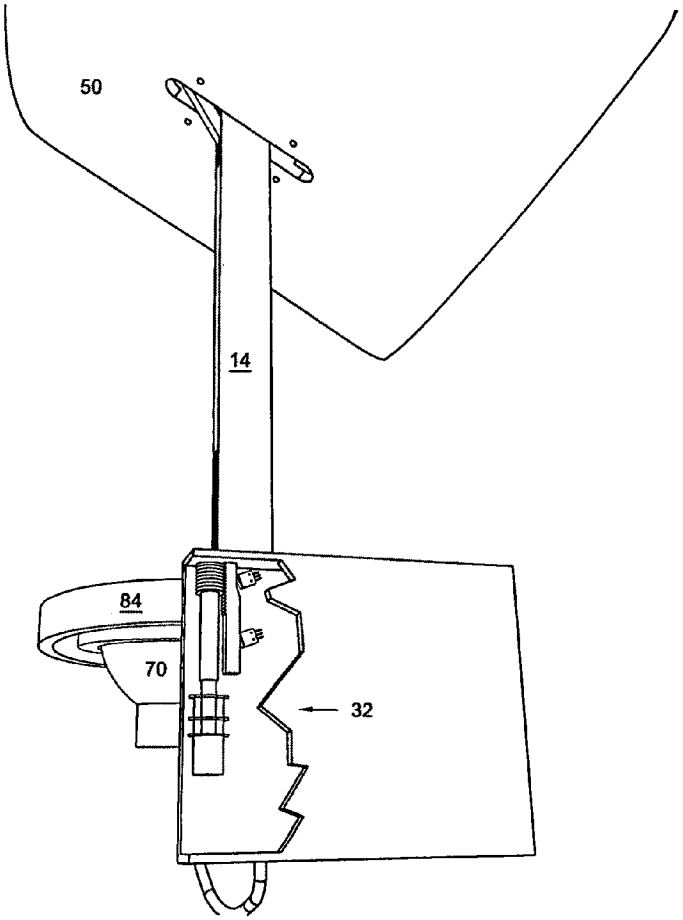
FIG. 54 is a side view of a momo.
Figure 55:
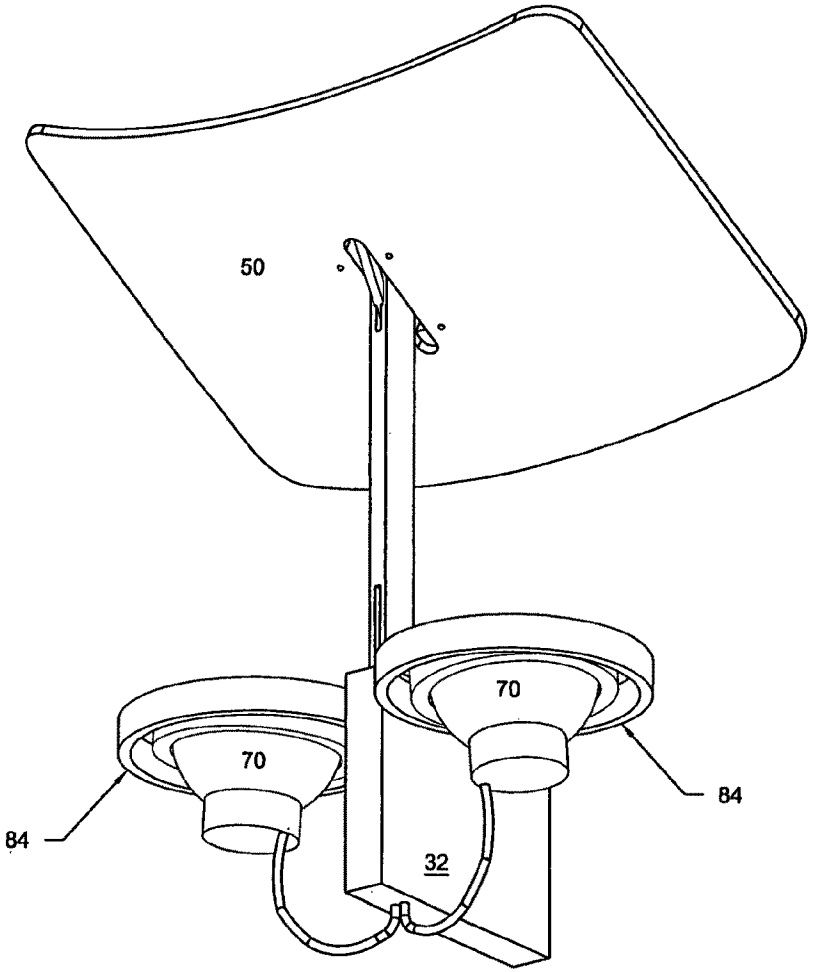
FIG. 55 is a perspective view of a momo with the reflector in a second position.

Momo-2: Technical Description of the Fixture as Represented by FIGS. 53-55

Momo-2 is a two-lamp fixture with gimbal-mounted lamps, combined with a screen with a motorized tilting mechanism. The gimbals allow small adjustments in pointing the light beams to a particular area of the reflecting screen, creating differences in beam characteristics of the reflected light.

The basis of the fixture is a slim rectangular volume that is to be mounted upon the wall, to which both gimbals are mounted; one at each side, so that the rectangular volume acts like a kind of wall between both gimbals.

On top of the rectangular volume, there is a stem that holds a reflecting screen at a distance of the lamps. This stem is a hollow tube, through which a rod is passing which makes an up-and-down movement. At the top, the rod takes the shape of a lever that translates the up-and-down movement into a tilting movement of the screen.

The rectangular volume contains the motor that powers the movement of the screen by causing the rod to move up or down, depending on the motor's spin direction. At the bottom, the rod takes the shape of a toothed rack, that is driven by a worm-wheel which is mounted upon the shaft of the motor. Microswitches prompt the motor movement to stop at the moment that the rod reaches both its maximum positions.

A discussion of additional reflectors is found in U.S. patent application Ser. No. 10/428,795, incorporated by reference herein; and a discussion of motorized lamps is found in U.S. patent application Ser. No. 10/123,798, incorporated by reference herein.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A lighting apparatus comprising:

a light source which includes a lamp;

a lamp compartment in which the lamp is disposed;

a motorized gimbal ring assembly that holds the light source and moves the light source, the motorized gimbal ring assembly including a motor, the gimbal ring assembly has an outer ring and an inner ring, when the outer ring is tilted, it will not affect the inner ring's position, the gimbal ring assembly movements, from North to South and from East to West, are endless loop movements so that when the motor keeps running, the gimbal ring assembly keeps tilting back and forth;

an outer housing disposed about the lamp compartment; and levers that transmit movements from the motor which are sandwiched by the outer housing and the lamp compartment, the outer housing covering the motor and levers that can be removed.

2. The apparatus of claim 1 wherein the motor causes the inner ring to move along with the outer ring in a lever activated tilting movement so that its relative position remains the same.

3. The apparatus of claim 2 including a concentric transmission axle, movements of the inner and outer rings are transmitted using the axle.

4. The apparatus of claim 3 wherein all movements of the gimbal ring assembly are accomplished with gears and levers.

5. The apparatus of claim 4 wherein the range of the gimbal ring assembly is 30°, 35° or 40°.

* * * * *